US008648585B2

(12) United States Patent
Ide

(10) Patent No.: US 8,648,585 B2
(45) Date of Patent: Feb. 11, 2014

(54) CIRCUIT INCLUDING FIRST AND SECOND TRANSISTORS COUPLED BETWEEN AN OUTPOUT TERMINAL AND A POWER SUPPLY

(75) Inventor: Akira Ide, Tokyo (JP)

(73) Assignee: Elpida Memory, Inc., Tokyo (JP)

( * ) Notice: Subject to any disclaimer, the term of this patent is extended or adjusted under 35 U.S.C. 154(b) by 232 days.

(21) Appl. No.: 12/285,089

(22) Filed: Sep. 29, 2008

(65) Prior Publication Data

US 2009/0085550 A1 Apr. 2, 2009

(30) Foreign Application Priority Data

Oct. 2, 2007 (JP) ..... P2007-258529

(51) Int. Cl.
*G05F 3/16* (2006.01)
*G05F 3/20* (2006.01)
*G05F 1/00* (2006.01)

(52) U.S. Cl.
USPC ..... 323/315; 323/271; 323/272

(58) Field of Classification Search
USPC ..... 323/313–317; 327/538–543
See application file for complete search history.

(56) References Cited

U.S. PATENT DOCUMENTS 6,456,166 B2 * 9/2002 Yabe ..... 331/34
6,466,080 B2 * 10/2002 Kawai et al. ..... 327/538
6,937,088 B2 * 8/2005 Hamamoto et al. ..... 327/541
7,002,394 B1 * 2/2006 Gilbert ..... 327/349
7,053,699 B2 * 5/2006 North ..... 327/590
7,057,448 B2 * 6/2006 Tanigawa et al. ..... 327/543
2004/0160258 A1 * 8/2004 Tobita ..... 327/333
2004/0251886 A1 * 12/2004 Balakrishnan et al. ..... 323/282
2005/0218872 A1 * 10/2005 Wich ..... 323/268
2005/0225360 A1 * 10/2005 Hachiya ..... 327/77
2007/0229166 A1 * 10/2007 Shor ..... 330/288
2010/0007326 A1 * 1/2010 Nakazato ..... 324/71.5

FOREIGN PATENT DOCUMENTS

JP 04-160511 3/1992
JP 2000-330657 11/2000
JP 2003-058264 A 2/2003

OTHER PUBLICATIONS

Japanese Office Action dated Oct. 1, 2013 with a partial English translation.

* cited by examiner

*Primary Examiner* — Adolf Berhane
*Assistant Examiner* — Emily P Pham
(74) *Attorney, Agent, or Firm* — McGinn IP Law Group, PLLC

(57) ABSTRACT

A constant current source circuit is constituted of a control voltage generation section which detects the output voltage at the output terminal so as to generate a control voltage, a reference current adjustment section which adjust a reference current based on the control voltage, and a current mirror section which outputs the output current responsive to the adjusted reference current at the output terminal. This reduces variations of the output current due to variations of the output voltage; hence, the constant current source circuit can precisely operate in a low-voltage region.

21 Claims, 16 Drawing Sheets

(RELATED ART)

(RELATED ART)

CIRCUIT INCLUDING FIRST AND SECOND TRANSISTORS COUPLED BETWEEN AN OUTPOUT TERMINAL AND A POWER SUPPLY

BACKGROUND OF THE INVENTION

1. Field of the Invention

The present invention relates to constant current source circuits that are used in integrated circuits and are produced by way of CMOS integrated circuit technologies.

The present application claims priority on Japanese Patent Application No. 2007-258529, the content of which is incorporated herein by reference.

2. Description of Related Art

It becomes difficult for engineers to determine lower limits for operation voltages of analog circuits due to demands for reducing operation voltages of LSI (Large Scale Integration) circuits used in electronic devices having reduced power consumptions.

This is greatly affected by the fact in which threshold voltages Vt for MOS (Metal Oxide Semiconductor) transistors will not be subjected to scaling relative to reductions of operation voltages.

For example, when the minimum output voltage of a constant current source is to be reduced, it is necessary to reduce the threshold voltage Vt of a MOS transistor in response to a reduction of the operation voltage.

However, there is a limit in reducing the threshold voltage Vt due to an increase of a leak current.

When low currents flow through MOS transistors each having a very large area so as to secure certain voltage margins by reducing voltages applied thereto, the manufacturing cost may be pushed up so as to cause demerits economically.

Various types of LSI circuits essentially incorporate constant current source circuits which have low current reductions in case of low voltages and which can stabilize currents in a relatively broad range of voltages.

Various types of constant current source circuits have been developed and disclosed in various documents such as Patent Document 1 and Patent Document 2.

Patent Document 1: Japanese Unexamined Patent Application Publication No. H04-160511

Patent Document 2: Japanese Unexamined Patent Application Publication No. 2000-330657

As a first example of the circuitry (serving as a constant current source circuit), FIG. 13 shows a current mirror circuit, wherein a reference current 10 flows through an n-channel MOS transistor M100 subjected to diode connection in which the same potential is applied to the gate and drain, hence, $V_{GS0}=V_{DS0}$.

A MOS transistor M101 is used as the output of the constant current source circuit, wherein when the gate voltage $V_{GS0}$ is identical to the drain voltage $V_{DS0}$, the same operation condition is applied to both of the transistors M100 and M101. When they have the same dimensions regarding the factor L/W (where L designates the channel length, and W designates the channel width), an output current $I_1$ becomes identical to the reference current $I_0$ (see Patent Document 1).

When an output voltage $V_{OUT}$ becomes higher than the gate voltage $V_{GS0}$, the effective channel length may decrease due to the channel length modifying effect of the transistor while the drain voltage of the transistor M101 increases, wherein the output current $I_1$ increases relative to the reference current $I_0$ so that $I_1>I_0$, whereby the same current does not flow through the transistors M100 and M101.

In contrast, when the output voltage $V_{OUT}$ becomes lower than the gate voltage $V_{GS0}$, the output current $I_1$ decreases so that $I_1<I_0$, wherein the same current does not flow through the transistors M100 and M101.

FIG. 14 shows an example of $I_{DS}$-$V_{DS}$ characteristics of an n-channel MOS transistor (where $I_{DS}$ designates a drain-source current, and $V_{DS}$ designates a drain-source voltage), whereby an output resistance $r_{OUT}$ of the circuitry of FIG. 13 substantially matches a drain resistance $r_{DS1}$ of the transistor M101 when the inverse of the slope of the drain current IDS in the saturation region is expressed as $r_{DS}=\Delta V_{DS}/\Delta I_{DS}$ (where $r_{DS}$ designates a drain resistance).

In order to suppress variations of the output current $I_1$ dependent upon the output voltage $V_{OUT}$, it is necessary to increase the output resistance $r_{OUT}$, whereas the circuitry of FIG. 13 suffers from a problem in that the output resistance $r_{OUT}$ cannot be increased to be higher than the drain resistance $r_{DS1}$.

In the case that $I_0$=100 μA and $r_{DS1}$=50 kΩ, for example, current variations of 20 μA occur responsive to voltage variations of 1 V; this causes relatively high current variations of 20%/V, resulting in an incapability of supplying a constant current at a high precision.

As a second example of the circuitry which is designed as the countermeasure to the circuitry of FIG. 13 by increasing the output resistance of a constant current source, FIG. 15 shows a cascode current mirror circuit constituted of transistors M100, M101, M102, and M103 (see Patent Document 2).

In the case of Patent Document 2, the gate potential of the transistor M101 is identical to the gate potential $V_{GS0}$, while the gate potential of the transistor M103 is identical to the gate potential $V_{GS0}+V_{GS2}$ of the transistor M102.

In the saturation region of the transistor M103, the gate-source voltage $V_{GS3}$ of the transistor M103 is identical to the gate-source voltage $V_{GS2}$ of the transistor M102; hence, the drain potential of the transistor M101 becomes identical to the gate-source voltage $V_{GS0}$ of the MOS transistor M100.

Since potential variations of the output terminal do not affect the drain voltage of the transistor M101, it is possible to increase the output resistance $r_{OUT}$, thus stabilizing the output current.

By use of the drain resistance $r_{DS3}$ and the mutual conductance gm3 of the transistor M103, gate-source voltage variations $\Delta V_{GS3}$ of the transistor M103 dependent upon output voltage variations $\Delta V_{OUT}$ is expressed as follows:

$$\Delta V_{GS3} = \frac{\Delta V_{OUT}}{gm3 \cdot r_{DS3}}$$

In the case that gm3=1 ms and $r_{DS3}$=50 kΩ, for example, the above equation can be rewritten as $\Delta V_{GS3}=\Delta V_{OUT}/50$. This indicates that potential variations of the output terminal may affect the drain potential of the MOS transistor M100 by 1/50 of the actual variations.

The output resistance $r_{OUT}$ of the circuitry of FIG. 15 is expressed as follows:

$$r_{OUT}=(gm3 \cdot r_{DS3}) \cdot r_{DS1}$$

Compared with the circuitry of FIG. 13, the circuitry of FIG. 15 provides (gm3·$r_{DS3}$) times higher output resistance. In the case that $I_0$=100 μA, $r_{DS1}=r_{DS3}$=50 kΩ, and gm3=1 mS, for example, the above equation produces $r_{OUT}$=2.5 MΩ, wherein potential variations of 1 V may result in current variations of 0.4 μA; hence, output current variations can be suppressed as 0.4%/V.

However, the present inventor has recognized that, in the constant current source circuit disclosed in Patent Document 2, due to the relatively high gate potential $V_{GS0}+V_{GS2}$ of the transistor M103, the transistor M103 produces the minimum value of the output voltage, i.e. $V_{OUT}$(min), during the operation in the saturation region.

$$V_{OUT}(\min) \geq V_{GS0}+V_{GS2}-V_{T3}$$

This reduces the range of operation voltage of the transistor M103 by $V_{GS2}$.

To cope with such a problem, as a further example of the constant current source circuit (having intermediate characteristics between the characteristics of Patent Document 1 and the characteristics of Patent Document 2), FIG. 16 shows a cascode current mirror circuit for use at a low voltage.

In the circuitry of FIG. 16 constituted of the four transistors M100 to M103, each of the drain voltages of the transistors M100 and M101 is expressed as $V_{DS0}$=Vncas−$V_{GS2}$ or $V_{DS1}$=Vncas−$V_{GS3}$ (where Vncas is a gate potential).

In the above, the drain voltages $V_{DS0}$ and $V_{DS1}$ are reduced by adjusting the gate potential Vncas with respect to the transistors M102 and M103, thus decreasing the lower limit of the operation voltage in a similar manner to the circuitry of FIG. 15.

Since both the drain voltages $V_{DS0}$ and $V_{DS1}$ are relatively low, both transistors M100 and M101 do not operate in the saturation region but in the linear region, wherein the characteristics thereof may be similar to resistance characteristics.

Since the drain voltages of the transistors M100 and M101 are maintained constant by way of the transistors M102 and M103, the circuitry of FIG. 16 is capable of operating as the constant current source.

The output resistance $r_{OUT}$ of the circuitry of FIG. 16 is identical to that of the circuitry of FIG. 15, where $r_{OUT}$=(gm3·$r_{DS3}$)·$r_{DS1}$.

Compared with the circuitry of FIG. 15, the drain resistance $r_{DS1}$ has a lower value in the circuitry of FIG. 16 that operates in the linear region. In the case that the current of 100 μA in which the gate potential Vncas is adjusted to achieve $V_{DS1}$=200 mV, it is possible to calculate the drain resistance $r_{DS1}$ by the following equation based on the approximation that the transistor M101 has a linear resistance.

$$r_{DS1} = \frac{200\ \text{mV}}{100\ \mu\text{A}} = 2\ \text{k}\Omega$$

In the case that $r_{DS3}$=50 kΩ and gm3=1 mS (in a similar manner to the circuitry of FIG. 15), $r_{OUT}$=100 kΩ, wherein current variations of 10 μA occur responsive to potential variations of 1 V; hence, it is possible to suppress output current variations by 10%/V.

The aforementioned calculations indicate that when the gate potential Vncas is intentionally reduced with respect to the transistors M102 and M103 in order to increase the lower-limit range of the operation voltage, the drain voltage $V_{DS1}$ becomes low so that the drain resistance $r_{DS1}$ correspondingly becomes low, thus reducing the output resistance $r_{OUT}$.

In order to obtain the cascode effect in the aforementioned circuitries, it is necessary to establish a balance between the operation voltage and the output resistance by increasing the drain voltage $V_{DS1}$.

In the case of the low-voltage cascode configuration, engineers cannot neglect a problem in that the range of the operation voltage is inevitably reduced by $V_{DS1}$.

SUMMARY

The invention seeks to solve one or more of the above problems, or to improve upon those problems at least in part.

In one embodiment, there is provided a constant current source circuit that includes a control voltage generation section for detecting the output voltage at the output terminal and for generating a control voltage based on the detected output voltage, a reference current adjustment section for adjusting a reference current based on the control voltage, and a current mirror section for outputting an output current responsive to the adjusted reference current at the output terminal.

In another embodiment, there is provided a constant current source circuit that includes a reference current adjustment section for adjusting a reference current based on the output voltage at the output terminal, and a current mirror section for outputting the output current in response to the adjusted reference current.

In the above, since the constant current source circuit of the present invention controls the reference current to be constant so as to reduce an influence of the output voltage to the output current at the output terminal, it is possible to reduce variations of the output current due to variations of the output voltage. Thus, the constant current source circuit is capable of supplying substantially the "constant" output current in the low-voltage range.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF PREFERRED EMBODIMENTS

The present invention will be now described herein with reference to illustrative embodiments. Those skilled in the art will recognize that many alternative embodiments can be accomplished using the teachings of the present invention and that the invention is not limited to the embodiments illustrated for explanatory purposes.

1. First Embodiment

Figure 1:
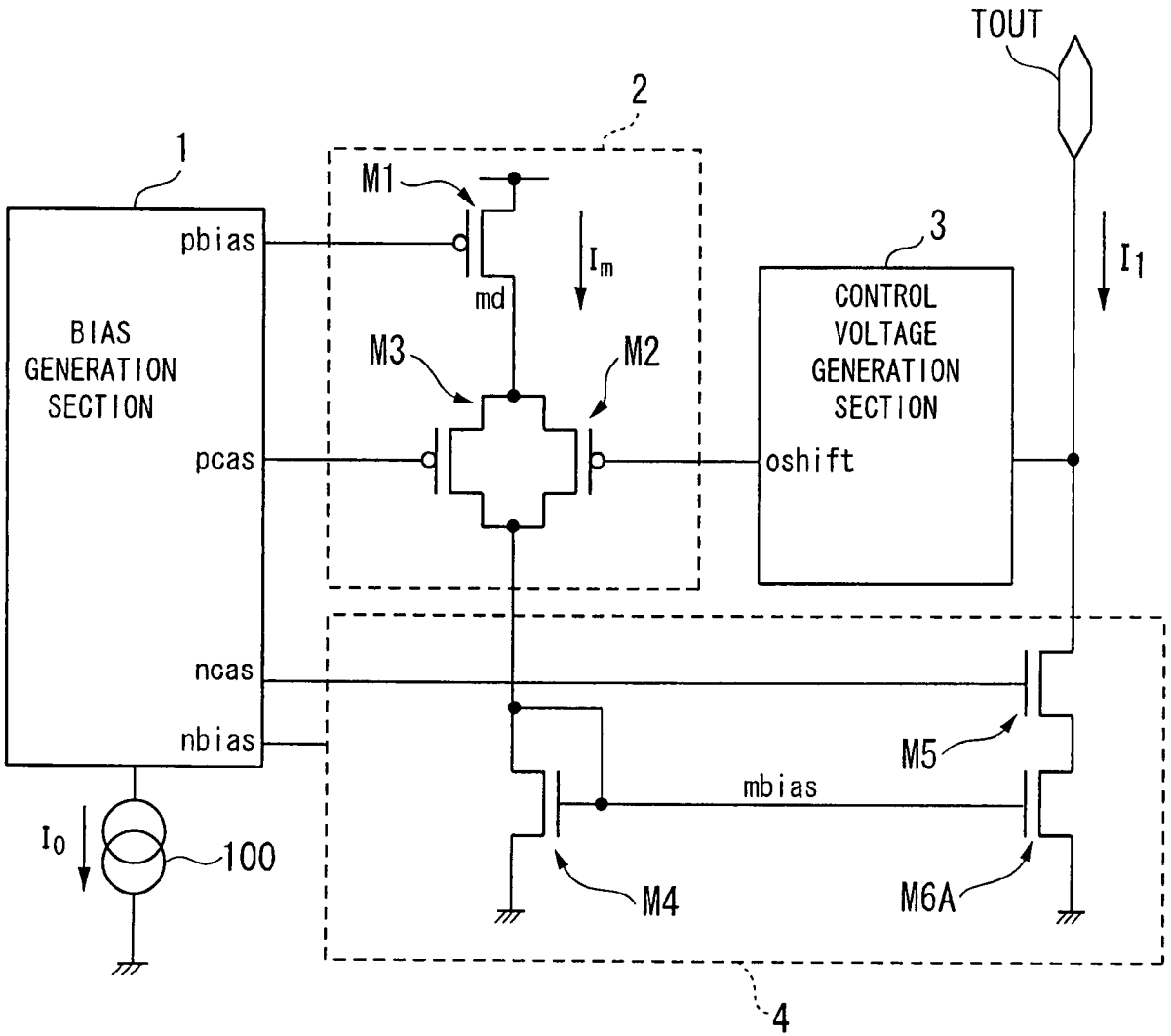
FIG. 1 is a block diagram showing the constitution of a constant current source circuit according to a first embodiment of the present invention.

Referring now to FIG. 1, a constant current source circuit according to a first embodiment of the present invention includes a bias generation section 1, a reference current adjustment section 2, a control voltage generation section 3, and a current mirror section 4.

Based on a reference current I0 caused by a constant current source 100, the bias generation section 1 generates a first bias voltage pbias and a second bias voltage pcas for use in the reference current adjustment section 2 as well as a third bias voltage ncas for use in the current mirror section 4.

The output voltage of an output terminal TOUT is applied to the control voltage generation section 3. The control voltage generation section 3 generates a control voltage oshift, which is produced by shifting a prescribed voltage from the output voltage. It outputs the control voltage oshift to the reference current adjustment section 2.

The reference current adjustment section 2 is constituted of p-channel MOS transistors M1, M2, and M3, which generates a current Im that is adjusted in response to the output voltage based on the first bias voltage pbias, the second bias voltage pcas, and the control voltage oshift.

The current mirror section 4 is a cascode current mirror circuit and is constituted of n-channel MOS transistors M4, M5, and M6A. It outputs a constant current I1 to the output terminal TOUT based on the current Im output from the reference current adjustment section 2.

Figure 2:
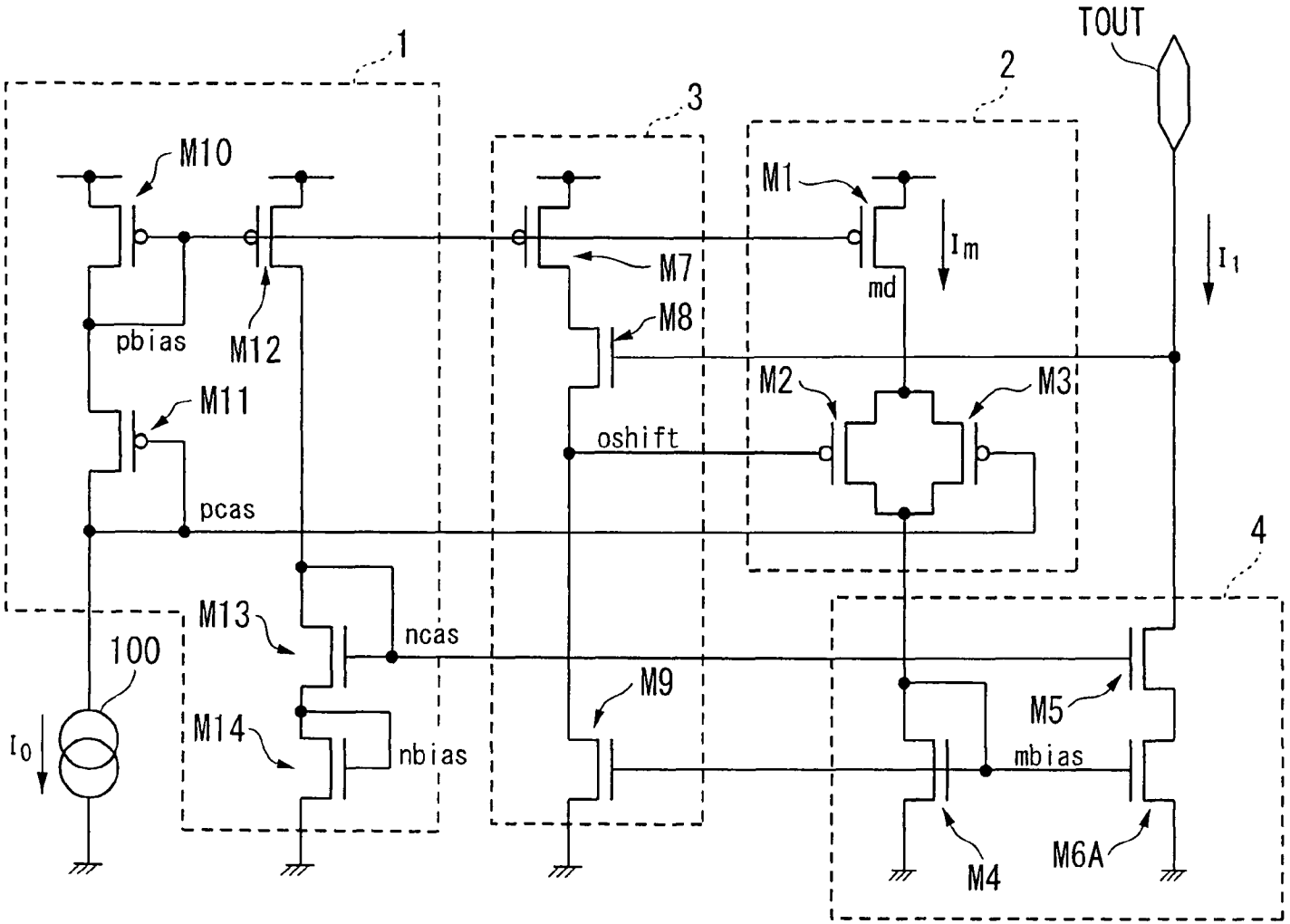
FIG. 2 is a circuit diagram showing the detailed constitution of the constant current source circuit of FIG. 1.

Next, the detailed constitution of the constant current source circuit of FIG. 1 will be described with reference to FIG. 2. FIG. 2 is a circuit diagram showing the detailed constitution of the constant current source circuit of FIG. 1.

The bias generation section 1 is constituted of p-channel MOS transistors M10, M11, and M12 and n-channel MOS transistors M13 and M14. The source of the transistor M10 is connected to a voltage supply, while the gate and the drain of the transistor M10 are connected together.

The source of the transistor M11 is connected to the drain and gate of the transistor M10, while the gate and drain of the transistor M11 are grounded via the constant current source 100.

The source of the transistor M12 is connected to the voltage supply, while the gate of the transistor M12 is connected to the gate and drain of the transistor M10.

The drain and gate of the transistor M13 are connected to the drain of the transistor M12.

The drain and gate of the transistor M14 are connected to the source of the transistor M13.

In the above constitution, the drain of the transistor M10 outputs the first bias voltage pbias to the transistor M1, which is a p-channel MOS transistor serving as a constant current source transistor of a cascode current mirror circuit.

The drain of the transistor M11 outputs the second bias voltage pcas to the transistor M3, which is a p-channel MOS transistor serving as a cascode transistor of the current mirror circuit.

The drain of the transistor M13 outputs the third bias voltage ncas to the transistor M5, which is an n-channel MOS transistor serving as an n-channel cascode transistor of the current mirror circuit.

The control voltage generation section 3 is constituted of a p-channel MOS transistor M7 and n-channel MOS transistors M8 and M9.

The source of the transistor M7 is connected to the voltage supply, while the gate of the transistor M7 is connected to the gate and drain of the transistor M10.

The drain of the transistor M8 is connected to the drain of the transistor M7, while the gate of the transistor M8 is connected to the output terminal TOUT.

The drain of the transistor M9 is connected to the source of the transistor M8, the source of the transistor M9 is grounded, and the gate of the transistor M9 is supplied with an internal bias voltage mbias of the "cascode" current mirror section 4.

The source of the transistor M8 outputs the control voltage oshift as a gate bias to the gate of the transistor M2 in the reference current adjustment section 2.

As described above, the reference current adjustment section 2 is constituted of the transistors M1, M2, and M3.

The source of the transistor M1 is connected to the voltage supply, while the gate of the transistor M1 is connected to the gate and drain of the transistor M10 so as to receive the first bias voltage pbias.

The source of the transistor M2 is connected to the drain of the transistor M1, while the gate of the transistor M2 is connected to the source of the transistor M8 so as to receive the control voltage oshift.

The source of the transistor M3 is connected to the drain of the transistor M1, while the gate of the transistor M3 is connected to the gate and drain of the transistor M11 so as to receive the second bias voltage pcas. The drain of the transistor M3 is connected to the drain of the transistor M2.

As described above, the current mirror section 4 is constituted of the transistors M4, M5, and M6A.

The gate and drain of the transistor M4 are connected to the drain of the transistor M2, while the source of the transistor M4 is grounded, wherein the drain of the transistor M4 outputs the internal bias voltage mbias. In addition, the gate and drain of the transistor M4 are connected to the gate of the transistor M9, which thus receives the internal bias voltage mbias.

The drain of the transistor M5 is connected to the output terminal TOUT, while the gate of the transistor M5 is connected to the gate and drain of the transistor M13 so as to receive the third bias voltage ncas.

The drain of the transistor M6A is connected to the source of the transistor M5, while the gate of the transistor M6A is connected to the gate and drain of the transistor M4 so as to receive the internal bias voltage mbias. The source of the transistor M6A is grounded.

Figure 3:
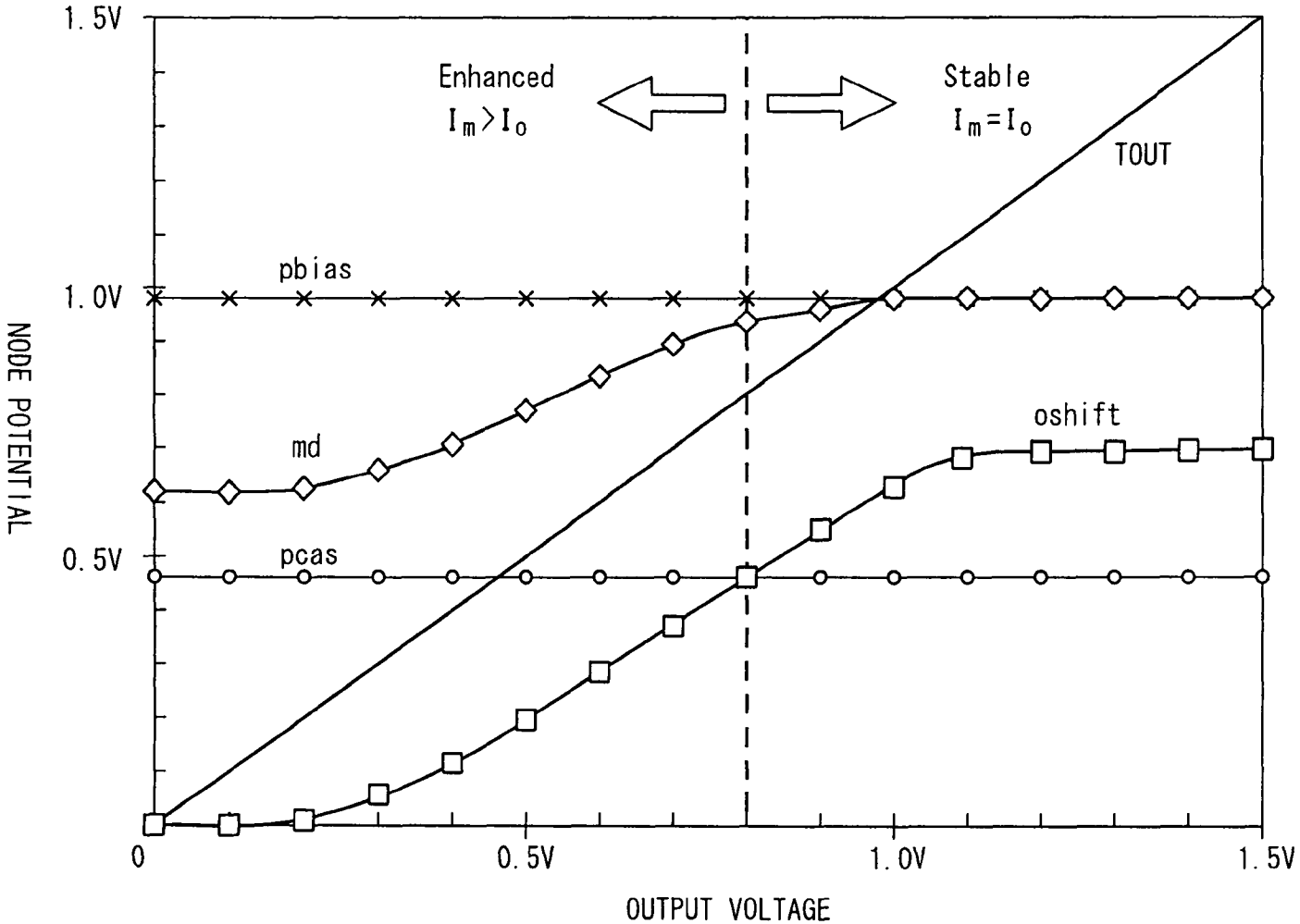
FIG. 3 is a graph showing potential variations of nodes dependent upon variations of output voltage in the constant current source circuit.

Next, the operation of the constant current source circuit of the first embodiment will be described with reference to FIG. 3. FIG. 3 shows simulation results of the constant current source circuit of FIG. 2, i.e., potential variations of nodes dependent upon variations of the output voltage in which the voltage supply is set to 1.5 V. The horizontal axis of the graph of FIG. 3 represents the potential (or output voltage) of the output terminal TOUT, and the vertical axis represents potentials of nodes in the constant current source circuit.

FIG. 3 apparently shows that the transistor M2 of the reference current adjustment section 2 is turned off when the control voltage oshift, which is produced by shifting the level of the output voltage of the output terminal TOUT in the control voltage generation section 3, is higher than the second bias voltage pcas generated by the bias generation section 1, wherein the potential of the drain "md" of the transistor M1 is clamped by the transistor M3 and therefore becomes identical to the first bias voltage pbias.

Since the transistors M1 and M3 are coupled together to form a cascode current mirror circuit, the current Im flowing through the MOS transistor M1 becomes identical to the reference current $I_0$.

In contrast, the transistor M3 of the reference current adjustment section 2 is turned off when the control voltage oshift is lower than the second bias voltage pcas, wherein the potential of the drain md of the transistor M1 decreases following up with variations of the control voltage oshift.

That is, the transistor M2 forms a bypass path allowing a current to pass therethrough, wherein the source-drain voltage of the transistor M1 increases as the control voltage oshift decreases, so that the current Im flowing through the transistor M1 becomes higher than the reference current $I_0$.

The dotted line vertically drawn in the center of the graph of FIG. 3 indicates the intersection point between the second bias voltage pcas and the control voltage oshift. In FIG. 3, the "stable" condition in which the relationship of $Im=I_0$ is fixed is established in the region (where pcas≤oshift) to the right of the dotted line.

In the region (where pcas>oshift) to the left of the dotted line, the reference current adjustment section 2 adjusts the current Im based on the voltage difference between the first bias voltage pbias and the potential of the drain md of the transistor M1, thus establishing the relationship of $Im>I_0$.

In short, the constant current source circuit of the first embodiment makes the current Im, which flows through the transistor M1 and which is adjusted based on the output voltage of the output terminal TOUT, flow through the transistor M4 of the current mirror section 4, thus producing the current $I_1$ in response to the current Im from the output terminal TOUT.

Figure 4:
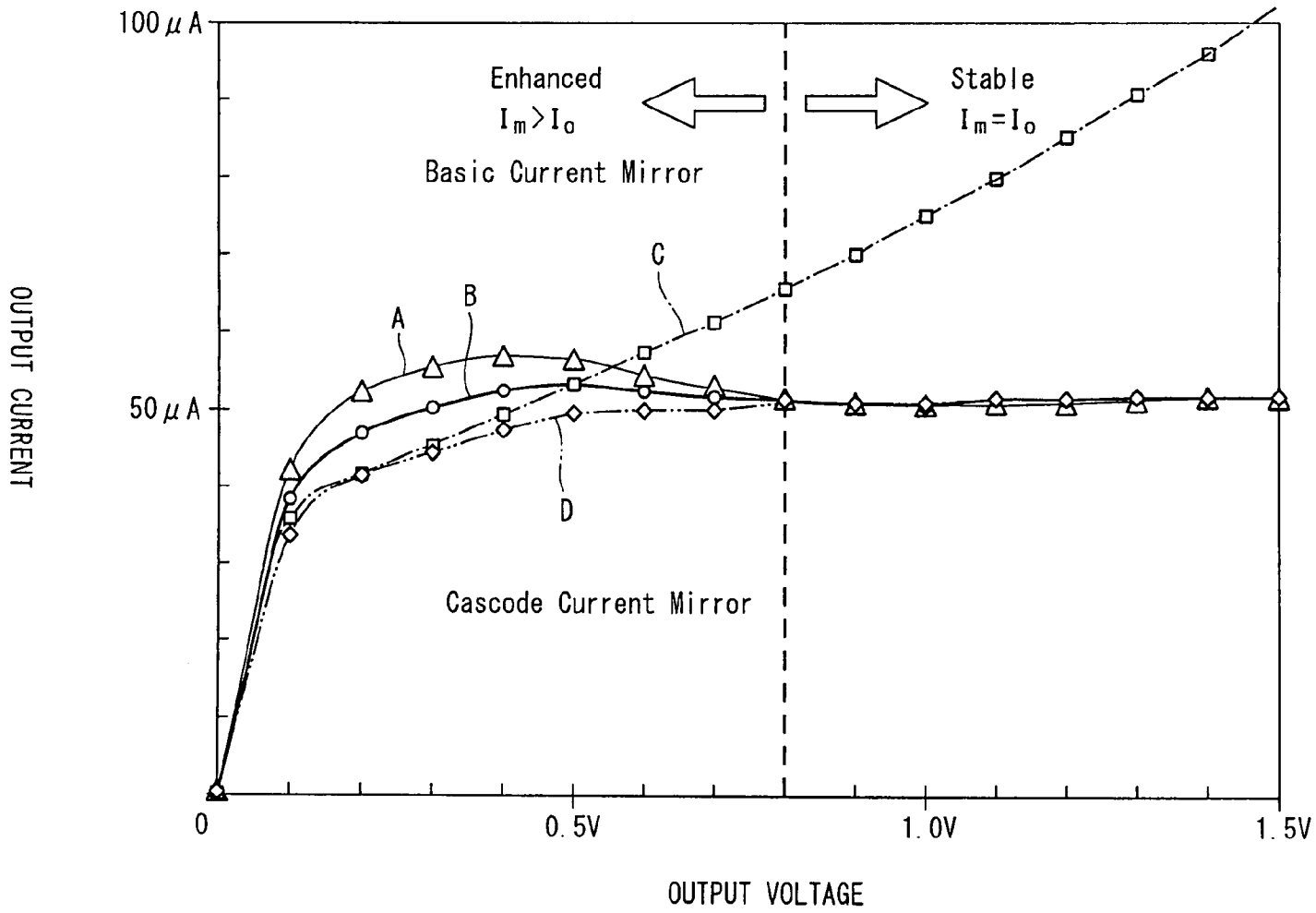
FIG. 4 is a graph showing the relationship between the output voltage and the output current in connection with constant current source circuits of first and second embodiments.

FIG. 4 is a graph showing the relationship between the output voltage at the output terminal TOUT and the output current $I_1$ in the constant current source circuit of the first embodiment. In FIG. 4, the horizontal axis represents the output voltage at the output terminal TOUT, while the vertical axis represents the output current $I_1$ output from the output terminal TOUT.

Figure 13:
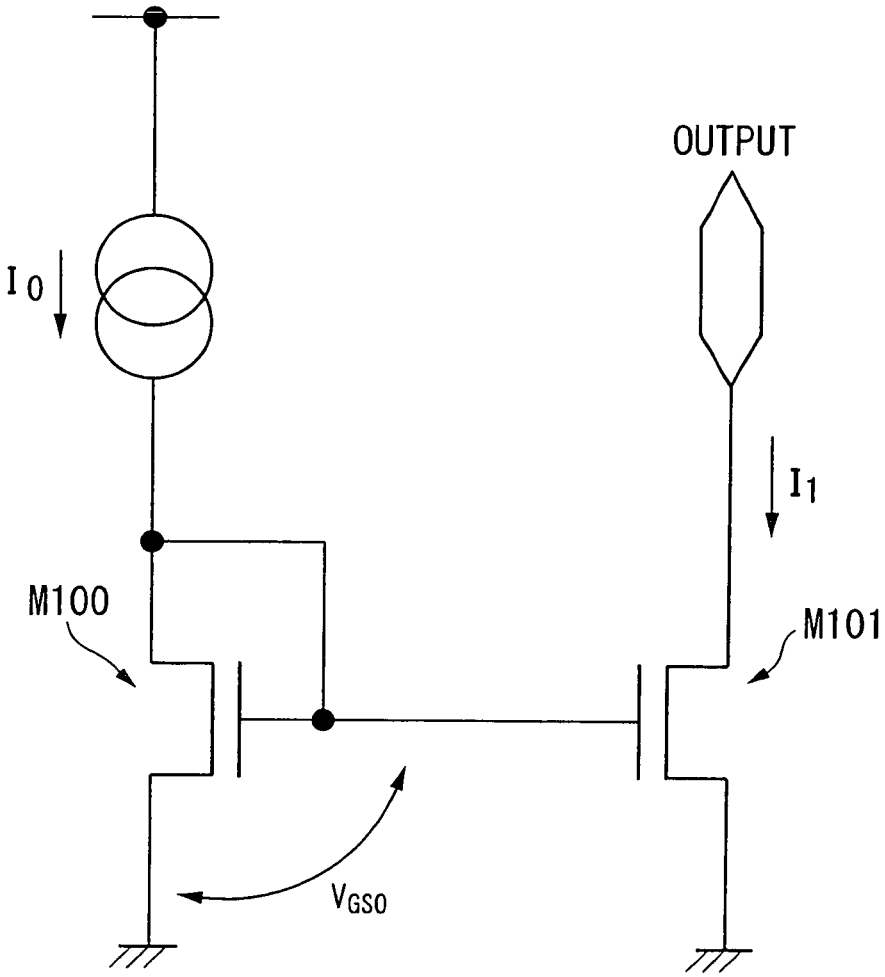
FIG. 13 is a circuit diagram showing one example of the constant current source circuit adapted to a current mirror circuit.
Figure 14:
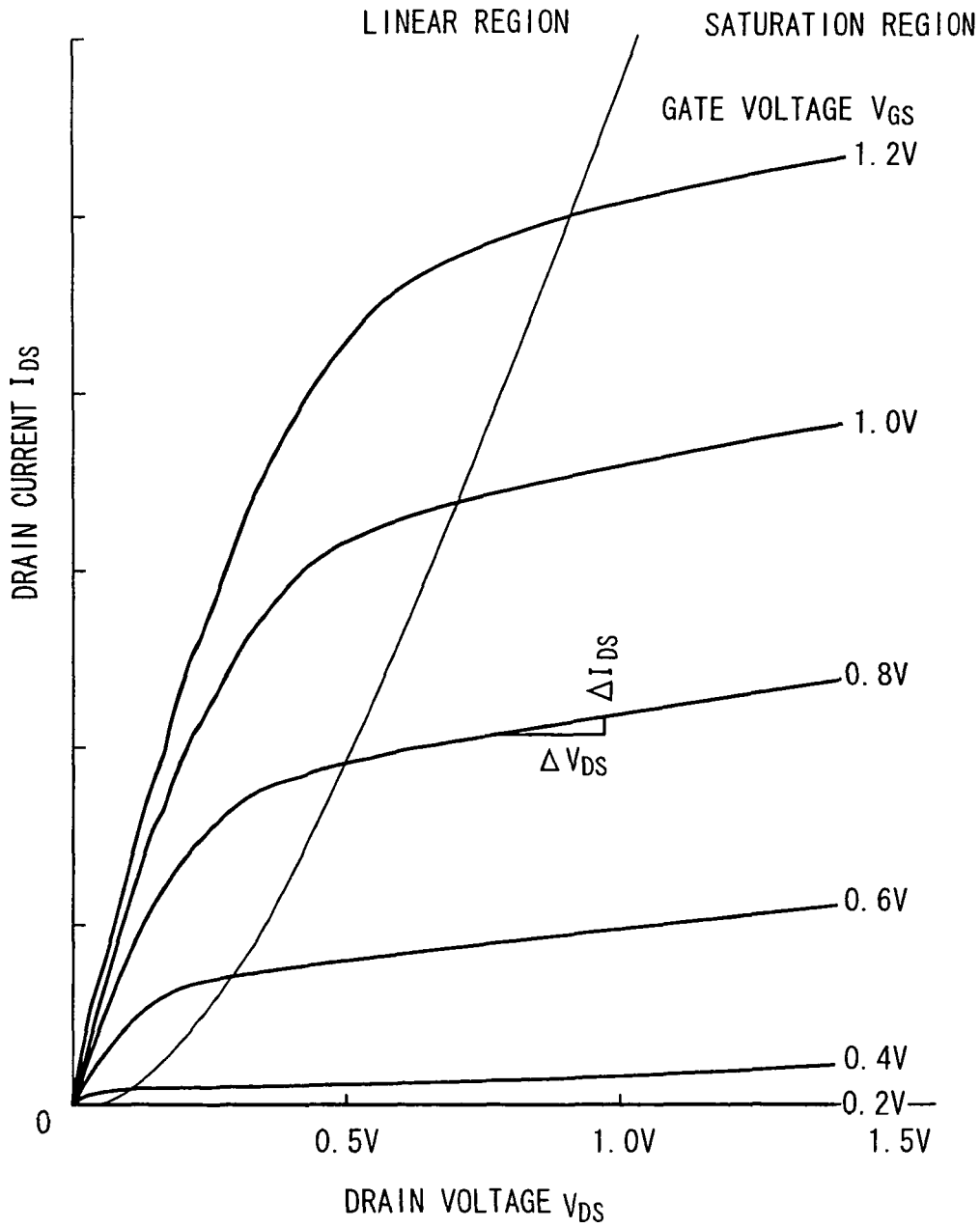
FIG. 14 is a graph showing current-voltage characteristics of an n-channel MOS transistor.
Figure 15:
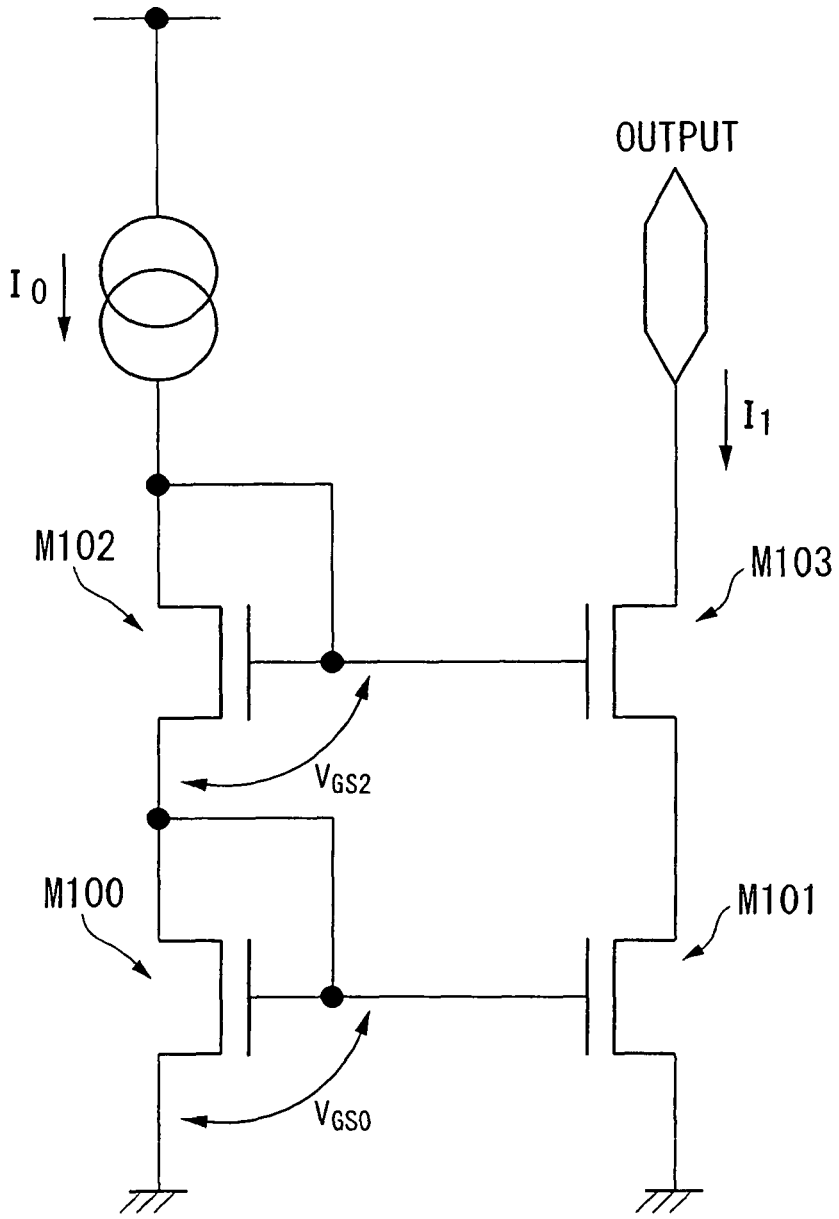
FIG. 15 is a circuit diagram showing another example of the constant current source circuit adapted to a cascode current mirror circuit.

In FIG. 4, a one-dashed curve C indicates the voltage-current characteristics of the first example of the circuitry (serving as the current mirror circuit) shown in FIG. 13, while a two-dashed curve D indicates the voltage-current characteristics of the second example of the circuitry (serving as the cascode current mirror circuit) shown in FIG. 15.

In relation to the curves C and D, a thin curve A indicates the voltage-current characteristics of the constant current source circuit of the first embodiment shown in FIG. 2.

In the characteristics D of the cascode current mirror circuit of FIG. 15, the transistor M103 cannot operate in the saturation region below the output voltage of 0.5 V so that the output resistance decreases so as to decrease the output current $I_1$.

As shown in FIG. 4, in the constant current source circuit of the first embodiment, the transistor M2 turns on so as to compensate for a reduction of the current Im occurring due to a reduction of the output voltage at the output terminal TOUT, wherein the current Im flowing through the transistor M1 is increased so as to expand the operation region below the output voltage of 0.2 V or so.

2. Second Embodiment

Figure 5:
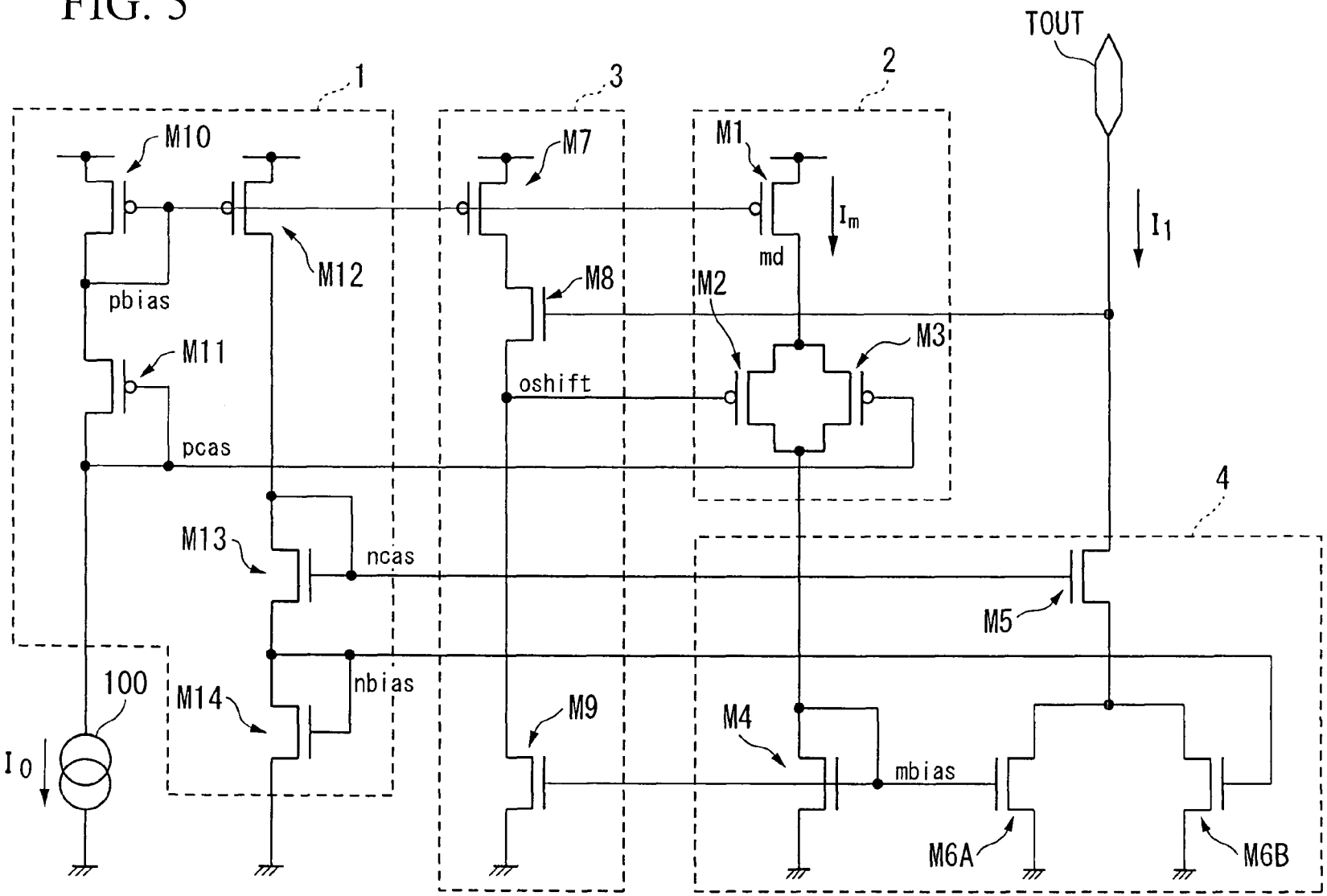
FIG. 5 is a circuit diagram showing the constitution of a constant current source circuit according to a second embodiment of the present invention.

Next, a constant current source circuit according to a second embodiment of the present invention will be described with reference to FIGS. 4 and 5. FIG. 5 is a circuit diagram showing the constitution of the constant current source circuit of the second embodiment.

Similar to the first embodiment, the constant current source circuit of the second embodiment is constituted of the bias generation section 1, the reference current adjustment section 2, the control voltage generation section 3, and the current mirror section 4.

In FIG. 5, parts identical to those of the first embodiment shown in FIG. 2 are designated by the same reference numerals; hence, only differences in the constitution and operation will be described with respect to the second embodiment.

Based on the reference current $I_0$ created by the constant current source 100, the bias generation section 1 generates and outputs the first bias voltage pbias and the second bias voltage pcas for use in the reference current adjustment section 2 as well as the third bias voltage ncas and the fourth bias voltage nbias for use in the current mirror section 4.

The fourth bias voltage nbias is output from the drain of the transistor M14 of the bias generation section 1.

In the current mirror section 4, a n-channel MOS transistor M6B is connected in parallel to the transistor M6A, wherein it is an additional constituent element incorporated into the second embodiment compared to the first embodiment.

The drain of the transistor M6B is connected to the source of the transistor M5; the gate of the transistor M6B is connected to the drain and gate of the transistor M14 so as to receive the fourth bias voltage nbias; and the source of the transistor M6B is grounded.

The current flowing through the transistor M6A has the voltage-current characteristics indicated by the thin curve A shown in FIG. 4.

The current flowing through the transistor M6B has the voltage-current characteristics indicated by the two-dashed curve D (representing the cascode current mirror circuit) shown in FIG. 4.

By appropriately adjusting the voltage-current characteristics applied to the transistors M6A and M6B, it is possible to achieve the intermediate characteristics indicated by a bold curve B between the thin curve A and the two-dashed curve D in FIG. 4.

That is, the second embodiment of FIG. 5 is designed to adjust the voltage-current characteristics from the thin curve A (which shows "excessive" current compensation characteristics) to the bold curve B (which shows "flat" characteristics compared to the characteristics of the thin curve A).

3. Third Embodiment

Figure 6:
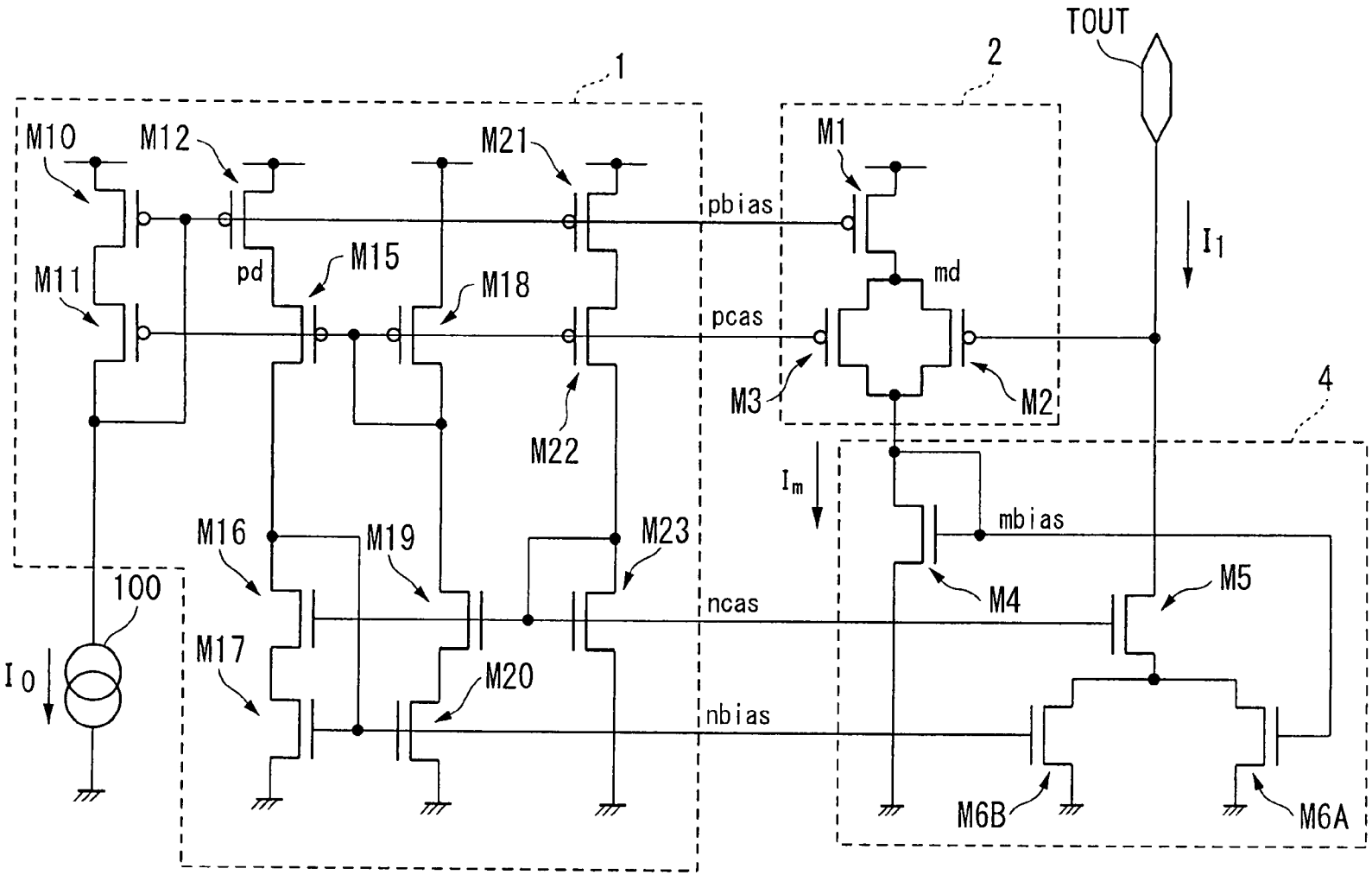
FIG. 6 is a circuit diagram showing the constitution of a constant current source circuit according to a third embodiment of the present invention.

Next, a constant current source circuit according to a third embodiment of the present invention will be described with reference to FIGS. 6 to 8. FIG. 6 is a circuit diagram showing the constitution of the constant current source circuit of the third embodiment. The third embodiment is designed to apply the reference current adjustment section 2 of the first embodiment to the low-voltage cascode current mirror circuit shown in FIG. 16.

The constant current source circuit of the third embodiment does not include the control voltage generation section 3 used in the first embodiment and is thus constituted of the bias generation section 1, the reference current adjustment section 2, and the current mirror section 4.

In FIG. 6, parts identical to those of the second embodiment shown in FIG. 5 are designated by the same reference numerals; hence, only differences in the constitution and operation will be described with reference to the third embodiment.

Due to the absence of the control voltage generation section 3, the gate of the transistor M2 is directly connected to the output terminal TOUT and is thus applied with the output voltage.

The bias generation section 1 included in the third embodiment is designed differently from the bias generation section 1 of the first embodiment and is constituted of p-channel MOS transistors M15, M18, M21, and M22 and n-channel MOS transistor M16, M17, M19, M20, and M23 as well as the transistors M10, M11, and M12.

In FIG. 6, the source of the transistor M10 is connected to the voltage supply, and the gate of the transistor M10 is connected to the constant current source 100, which is grounded.

The source of the transistor M11 is connected to the drain of the transistor M10, and the drain of the transistor M11 is connected to the gate of the transistor M10 and is also connected to the constant current source 100, which is grounded.

In the above constitution, the transistors M10 and M11 generate the first bias voltage pbias based on the current $I_0$ created by the constant current source 100.

The transistor M11 serving as a cascode transistor is arranged to maintain the current flowing through the transistor M10 constant.

Since the gate of the transistor M10 is connected to the drain of the transistor M11, the transistor M10 normally operates in the linear region.

The source of the transistor M12 is connected to the voltage supply, and the gate of the transistor M12 is connected to the gate of the transistor M10 and the drain of the transistor M11.

The source of the transistor M15 is connected to the drain of the transistor M12, and the gate of the transistor M15 is connected to the gate of the transistor M11.

The drain of the transistor M16 is connected to the drain of the transistor M15.

The drain of the transistor M17 is connected to the source of the transistor M16, the gate of the MOS transistor M17 is connected to the drain of the transistor M16, and the source of the transistor M17 is grounded.

In the above constitution, the transistors M12 and M15 form a current mirror circuit which makes the prescribed current corresponding to the reference current $I_0$ flow through the transistors M16 and M17.

The transistors M16 and M17 generate the fourth bias voltage nbias.

The source of the transistor M18 is connected to the voltage supply, and the gate and drain of the transistor M18 are connected to the gates of the transistors M11 and M15.

The drain of the transistor M19 is connected to the gate and drain of the transistor M18, and the gate of the transistor M19 is connected to the gate of the transistor M16.

The drain of the transistor M20 is connected to the source of the transistor M19, and the gate of the transistor M20 is connected to the drain of the transistor M16 and the gate of the transistor M17. The source of the transistor M20 is grounded.

In the above constitution, the transistors M19 and M20 form a current mirror circuit which makes the prescribed current (corresponding to the current flowing through the transistor M17) flow through the transistor M18. By appropriately adjusting the size (or dimensions) of the transistor M18, they generate the second bias voltage pcas having the prescribed level.

The source of the transistor M21 is connected to the voltage supply, and the gate of the transistor M21 is connected to the gate of the transistor M10 and the drain of the transistor M11.

The source of the transistor M22 is connected to the drain of the transistor M21, and the gate of the transistor M22 is connected to the gate and drain of the transistor M18.

The gate and drain of the transistor M23 are connected to the drain of the transistor M22 and the gate of the transistor M19, and the source of the transistor M23 is grounded.

In the above constitution, the transistors M21 and M22 form a current mirror circuit which makes prescribed current (corresponding to the current flowing through the transistor M10) flow through the transistor M23. By appropriately adjusting the size (or dimensions) of the transistor M23, they generate the third bias voltage ncas having the prescribed level.

The drain of the transistor M11 outputs the first bias voltage pbias to the gate of the transistor M1 included in the reference current adjustment section 2.

The drain of the transistor M18 outputs the second bias voltage pcas to the gate of the transistor M3 included in the reference current adjustment section 2.

The drain of the transistor M23 outputs the third bias voltage ncas to the gate of the transistor M5 included in the current mirror section 4.

The drain of the transistor M16 outputs the fourth bias voltage nbias to the gate of the transistor MB6 included in the current mirror section 4.

As described above, the constant current source circuit of the third embodiment shown in FIG. 6 does not include the control voltage generation section 3, which is included in both of the first and second embodiments.

The reason why the control voltage generation section 3 is not arranged in the third embodiment is that the second bias voltage pcas is maintained at a relatively high level in the low-voltage cascode current mirror circuit.

If the third embodiment is designed in a similar manner to the first and second embodiment, the control voltage generation section 3 performs level shifting so as to supply the control voltage oshift, which is lower than the output voltage of the output terminal TOUT, to the gate of the transistor M2, wherein the intersecting point between the second bias voltage pcas and the control voltage oshift should be raised to a very high level compared to the output voltage of the output terminal TOUT.

In this case, the output current $I_1$ should be excessively corrected in the stable region in which the output current $I_1$ is not corrected any more.

In order to avoid the occurrence of the above phenomenon, the third embodiment is designed so as not to arrange the control voltage generation section 3 but to directly connect the output terminal TOUT to the gate of the transistor M2, wherein the output voltage of the output terminal TOUT is directly applied to the gate of the transistor M2.

Next, the operation of the constant current source circuit of the third embodiment will be described with reference to FIG. 7. FIG. 7 shows simulation results of the constant current source circuit of FIG. 6, wherein similar to FIG. 3, FIG. 7 shows variations of the output voltage which is produced based on the supply voltage of 1.5 V. In FIG. 7, the horizontal axis represents the output voltage of the output terminal TOUT, and the vertical axis represents potentials of various nodes.

Figure 7:
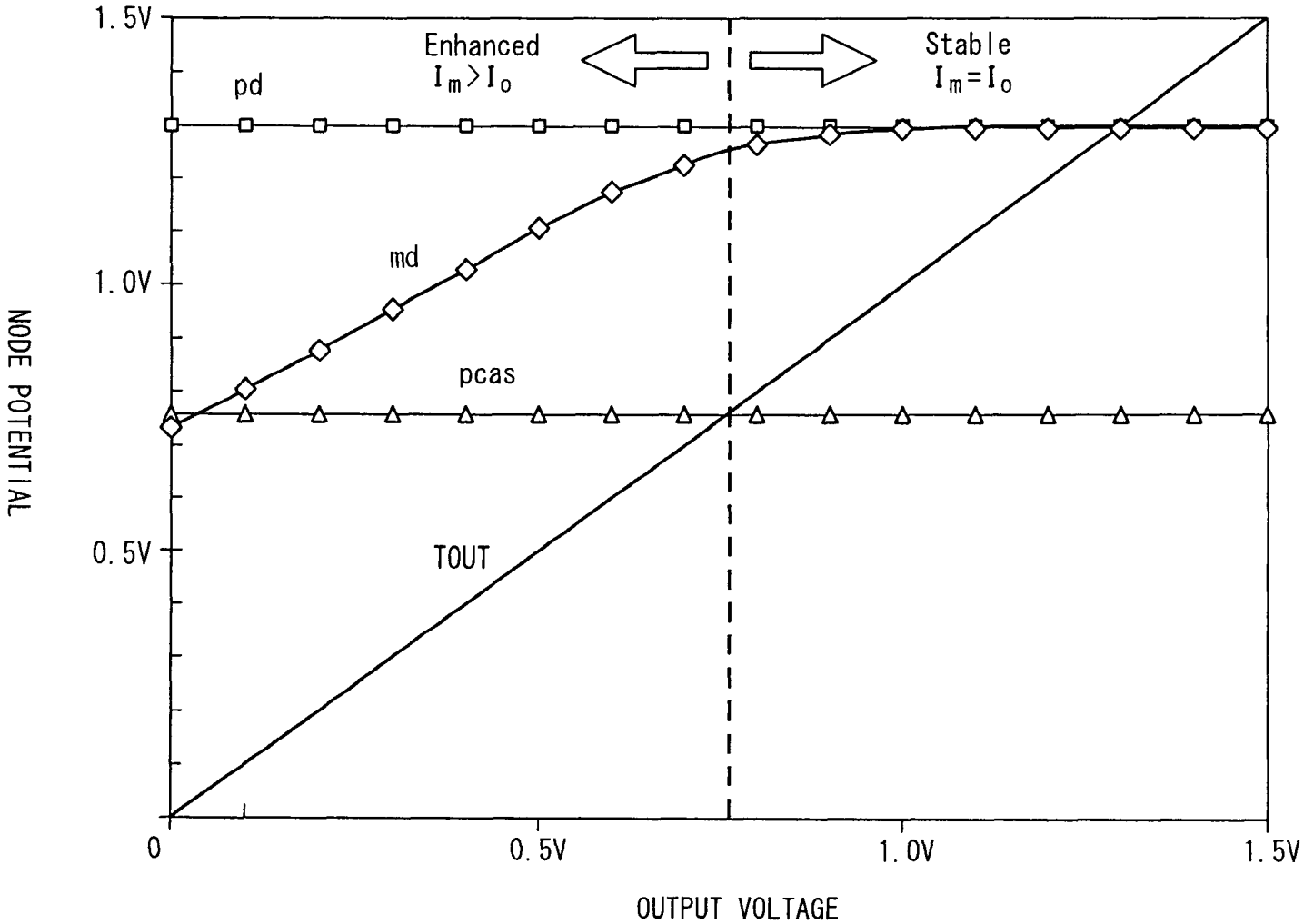
FIG. 7 is a graph showing potential variations of nodes dependent upon variations of output voltage in the constant current source circuit of the third embodiment.

In the region to the right of the intersecting point between the output voltage of the output terminal TOUT and the second bias voltage pcas in FIG. 7, the potential of the drain md of the transistor M1 is maintained to be substantially identical to the potential of the drain pd of the transistor M12, wherein the current Im flowing through the transistor M1 becomes identical to the current $I_0$, i.e., $Im=I_0$.

In the region to the left of the intersecting point in FIG. 7, the output voltage of the output terminal TOUT gets smaller in comparison with the second bias voltage pcas, wherein the difference between the potential of the drain pd of the transistor M12 and the potential of the drain md of the transistor M1 is additionally applied to the drain of the transistor M1; hence, $Im>I_0$.

Figure 8:
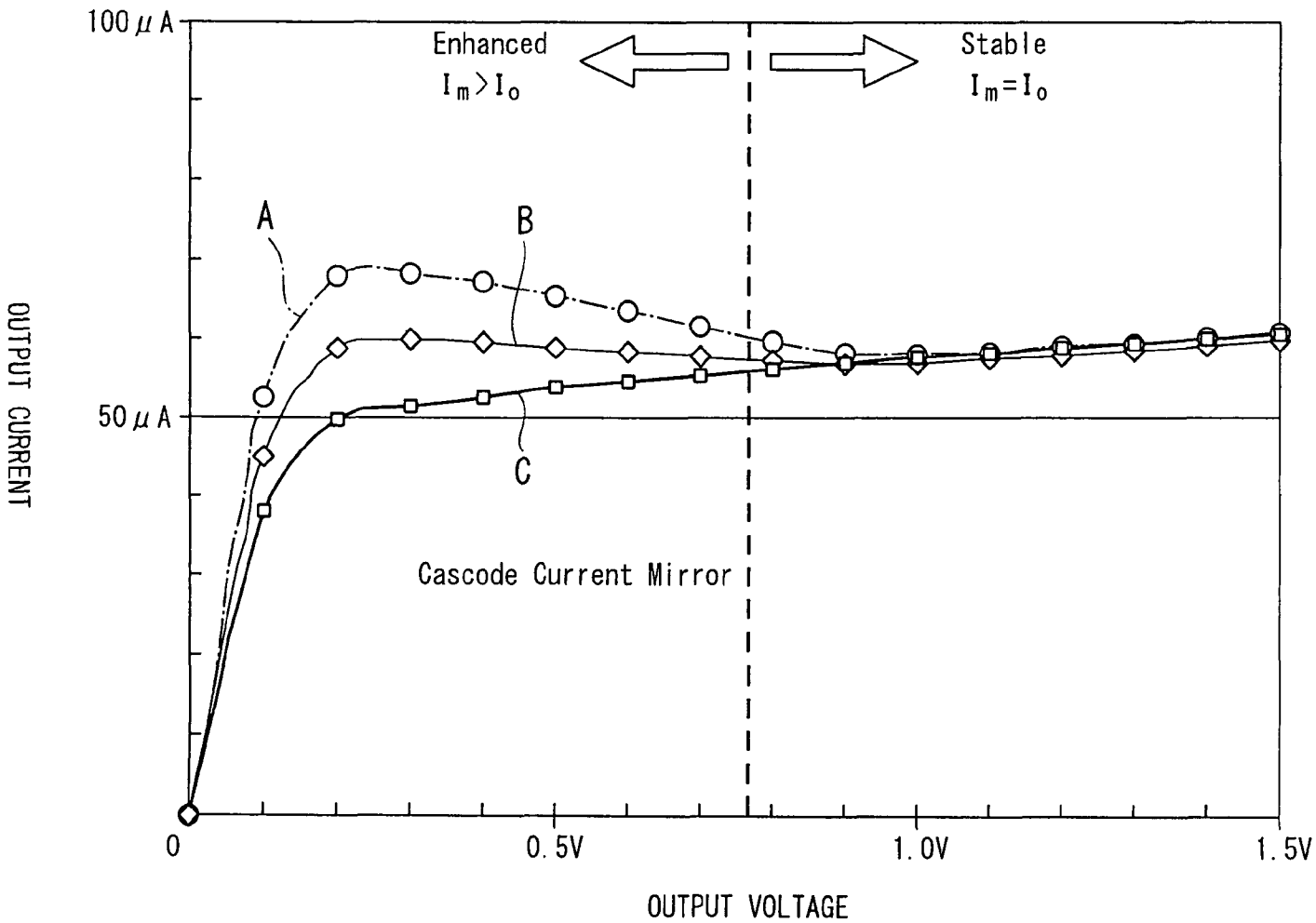
FIG. 8 is a graph showing the relationship between the output voltage and the output current in the constant current source circuit of the third embodiment.

FIG. 8 is a graph showing the relationship between the output voltage of the output terminal TOUT and the output current $I_1$ in the constant current source circuit of the third embodiment. In FIG. 8, the horizontal axis represents the output voltage of the output terminal TOUT, and the vertical axis represents the output current $I_1$ output from the output terminal TOUT.

In FIG. 8, a bold line C indicates the voltage-current characteristics of the low-voltage cascode current mirror circuit. A dashed line A indicates the voltage-current characteristics of the constant current source circuit (excluding the transistor M6B) which outputs the current Im at 100%. A thin line B indicates the voltage-current characteristics of the constant current source circuit in which the transistor M6A outputs the current Im and $I_0$ at 50% each.

Figure 16:
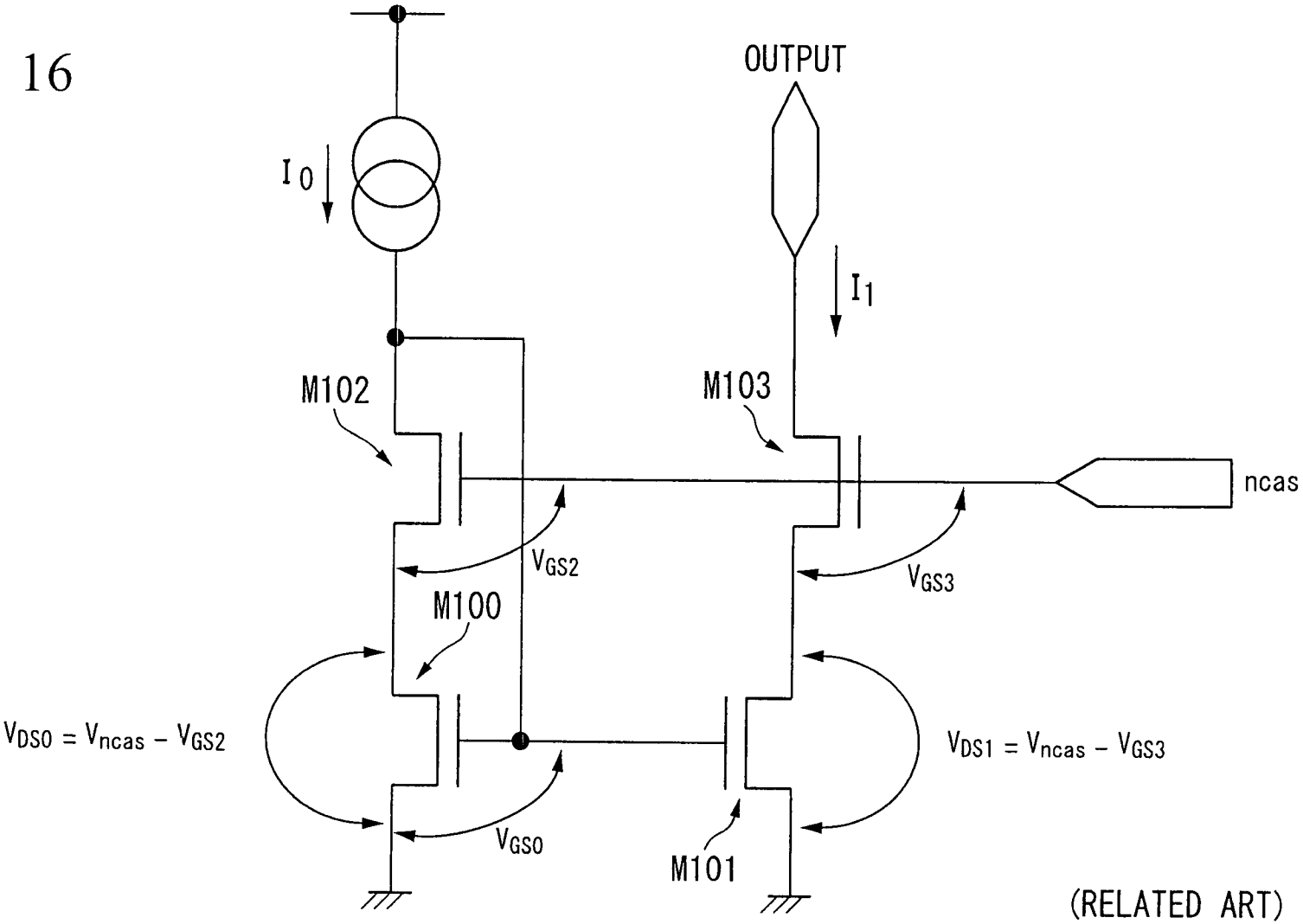
FIG. 16 is a circuit diagram showing a further example of the constant current source circuit adapted to a cascode current mirror circuit for low voltage.

FIG. 8 clearly shows that, in the constant current source circuit of the third embodiment compared to the low-voltage cascode current mirror circuit shown in FIG. 16, the transistor M2 turns on so as to compensate for a reduction of the current Im due to a reduction of the output voltage of the output terminal TOUT, wherein it is possible to expand the operation region below the output voltage of 0.2 V or so by increasing the current Im flowing through the transistor M1.

4. Fourth Embodiment

Figure 9:
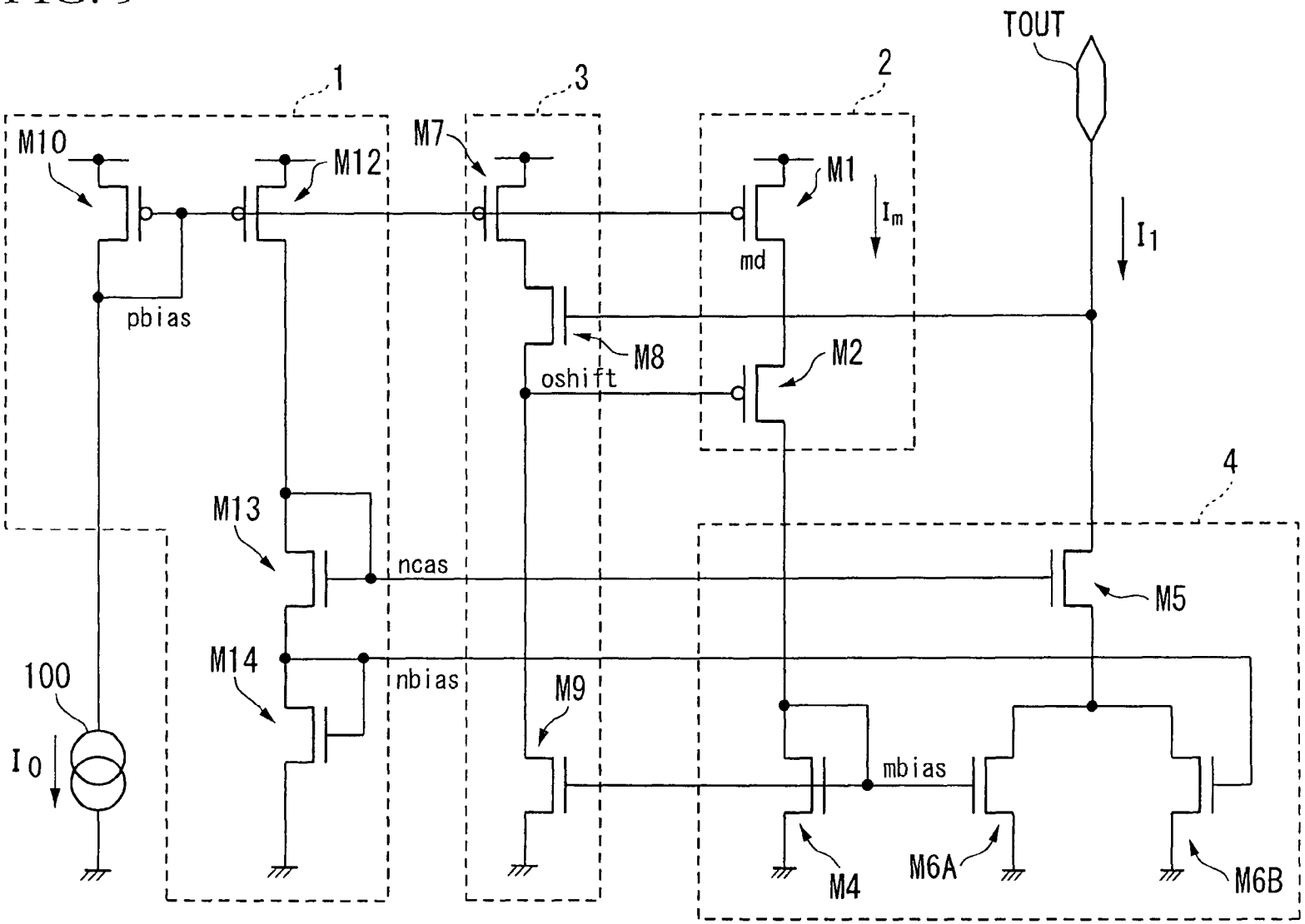
FIG. 9 is a circuit diagram showing the constitution of a constant current source circuit according to a fourth embodiment of the present invention.

Next, a constant current source circuit according to a fourth embodiment of the present invention will be described with reference to FIG. 9. FIG. 9 is a circuit diagram showing the constitution of the constant current source circuit of the fourth embodiment, which is designed by eliminating the transistor M3 from the reference current adjustment section 2 compared to the reference current adjustment section 2 included in the constant current source circuit of the second embodiment shown in FIG. 5. Due to the elimination of the transistor M3, it is unnecessary to produce the second bias voltage pcas; hence, the transistor M11 is also eliminated from the bias generation section 1.

In FIG. 9, parts identical to those of the second embodiment shown in FIG. 5 are designated by the same reference numerals; hence, only differences in the constitution and operation will be described with respect to the fourth embodiment.

The source of the transistor M10 is connected to the voltage supply, and the gate and drain of the transistor M10 are connected to the constant current source 100, which is grounded.

In the above constitution, when the output voltage of the output terminal TOUT increases to be higher in level, the source-drain voltage of the transistor M8 (configured of an n-channel MOS transistor) decreases so that the operating state of the constant current source circuit is changed from the saturation region to the linear region.

In the linear region, the transistor M8 cannot achieve the source-follower function. This is clearly shown in FIG. 3 in terms of the relationship between the control voltage oshift and the output voltage of the output terminal TOUT. In FIG. 3, the control voltage oshift is maintained in a flat manner above the output voltage of 1.1 V.

In the fifth embodiment in which the transistor M3 is eliminated from the second embodiment, the transistor M2 does not turn off even when the output voltage of the output terminal TOUT increases to be higher in level in the right region from the dotted line in FIG. 3 or FIG. 4. This makes it possible for the current Im to flow through the transistors M1 and M2.

In the region to the right of the dotted line in FIG. 4, the function for maintaining the constant current due to the cascode effect may disappear, whereby a tendency in which the output current $I_1$ gradually decreases appears in the region to the right of the dotted line.

The fourth embodiment works effectively in the case in which the output voltage of the output terminal TOUT is used in only the low-level region in a similar manner to a tail current of a differential amplifier (not shown).

5. Fifth Embodiment

Figure 10:
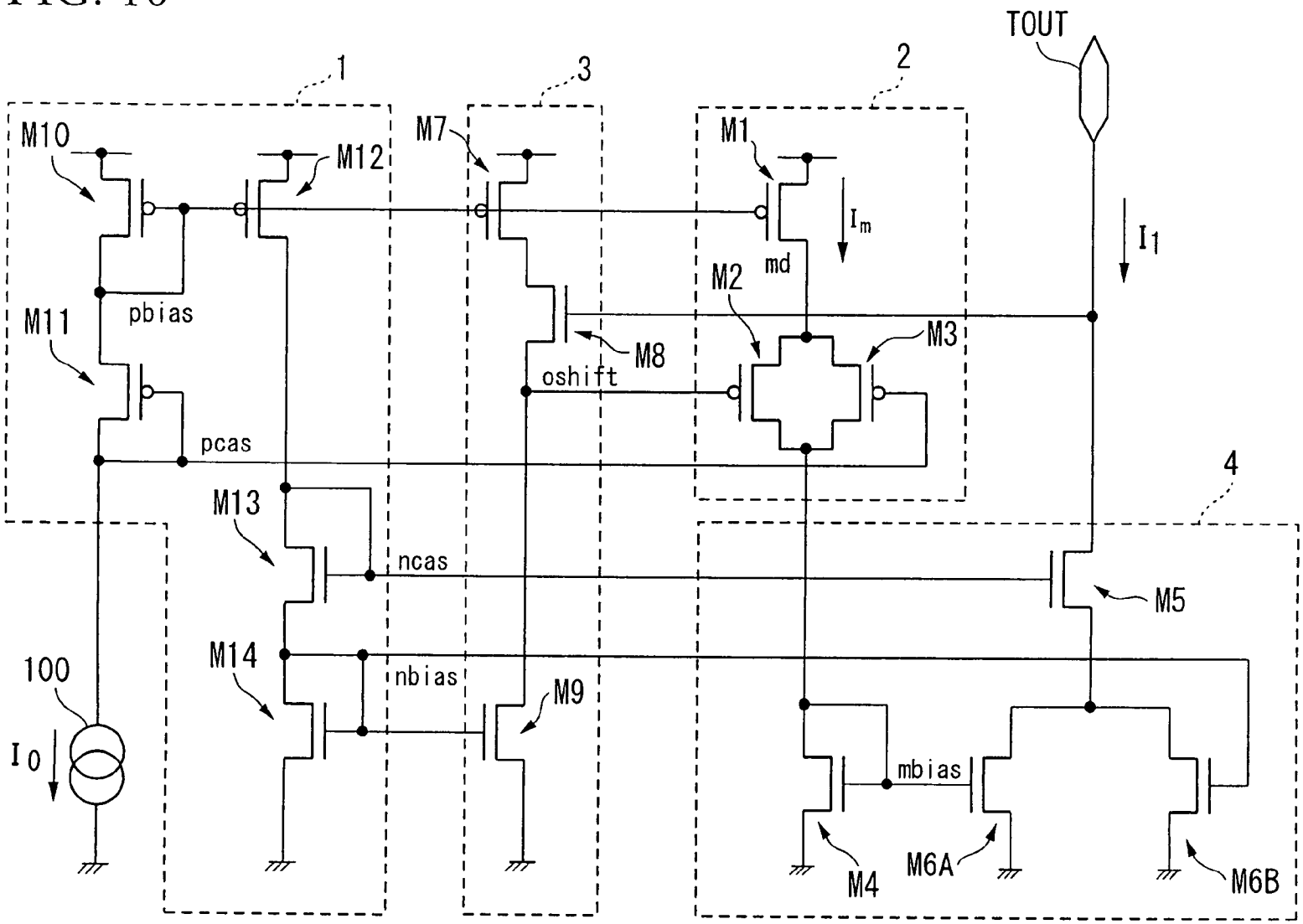
FIG. 10 is a circuit diagram showing the constitution of a constant current source circuit according to a fifth embodiment of the present invention.

Next, a constant current source circuit according to a fifth embodiment of the present invention will be described with reference to FIG. 10. FIG. 10 is a circuit diagram showing the constitution of the constant current source circuit of the fifth embodiment.

In FIG. 10, parts identical to those of the second embodiment shown in FIG. 5 are designated by the same reference numerals; hence, only differences in the constitution and operation will be described with respect to the fifth embodiment.

Instead of the internal bias voltage mbias of the current mirror section 4, the fourth bias voltage nbias is applied to the gate of the transistor M9 of the control voltage generation section 3 included in the constant current source circuit of the fifth embodiment compared to the second embodiment. The drain of the transistor M9 is connected to the source of the transistor M8, and the gate of the transistor M9 is connected to the gate and drain of the transistor M14.

When the internal bias voltage (or gate bias voltage) mbias is applied to the gate of the transistor M9, the drain current of the transistor M9 is forced to be maintained constant in the region to the left of the dotted line in FIG. 4 which occurs due to a reduction of the output voltage of the output terminal TOUT. This may excessively reduce the control voltage oshift.

Since the fourth bias voltage nbias is applied to the gate of the transistor M9, even when the output voltage of the output terminal TOUT decreases such that the control voltage oshift (which corresponds to the drain voltage of the transistor M9) also decreases, it is possible to moderate an excessive reduction of the control voltage oshift by way of a reduction of the drain current of the transistor M9, thus making it possible to relieve the output current $I_1$ from further correcting.

6. Sixth Embodiment

Figure 11:
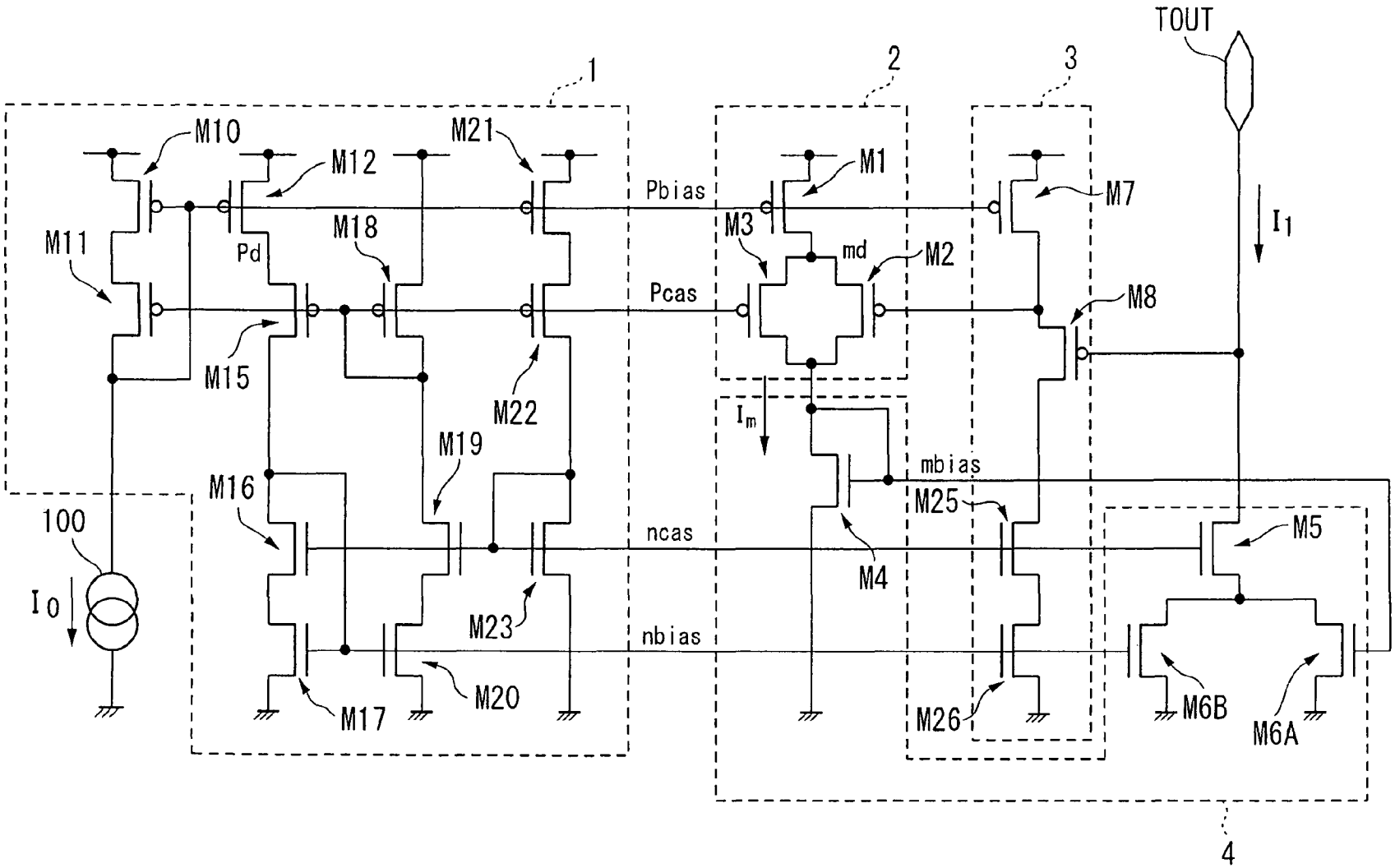
FIG. 11 is a circuit diagram showing the constitution of a constant current source circuit according to a sixth embodiment of the present invention.

Next, a constant current source circuit according to a sixth embodiment of the present invention will be described with reference to FIG. 11. FIG. 11 is a circuit diagram showing the constitution of the constant current source circuit of the sixth embodiment.

The sixth embodiment shown in FIG. 11 is designed to additionally introduce the control voltage generation section 3 into the third embodiment shown in FIG. 6. In FIG. 11, parts identical to those of the third embodiment shown in FIG. 6 are designated by the same reference numerals; hence, only differences in the constitution and operation will be described with respect to the sixth embodiment.

The control voltage generation section 3 is constituted of n-channel MOS transistors M25 and M26 as well as the p-channel MOS transistors M7 and M8.

The source of the transistor M7 is connected to a voltage supply, and the gate of the transistor M7 is connected to the drain of the transistor M11.

The source of the transistor M8 is connected to the drain of the transistor M7, and the gate of the transistor M8 is connected to the output terminal TOUT.

The drain of the transistor M25 is connected to the drain of the transistor M8, and the gate of the transistor M25 is connected to the drain of the transistor M23 so as to receive the third bias voltage ncas.

The drain of the transistor M26 is connected to the source of the transistor M25, and the gate of the transistor M26 is connected to the drain of the transistor M16 so as to receive the fourth bias voltage nbias. The source of the transistor M26 is grounded.

In the above constitution, when the voltage higher than the output voltage of the output terminal TOUT is applied to the gate of the transistor M2, the dotted lines of FIGS. 7 and 8 are moved leftward so as to moderate the excessive correction, thus achieving the flat characteristics with respect to the output current $I_1$.

7. Seventh Embodiment

Figure 12:
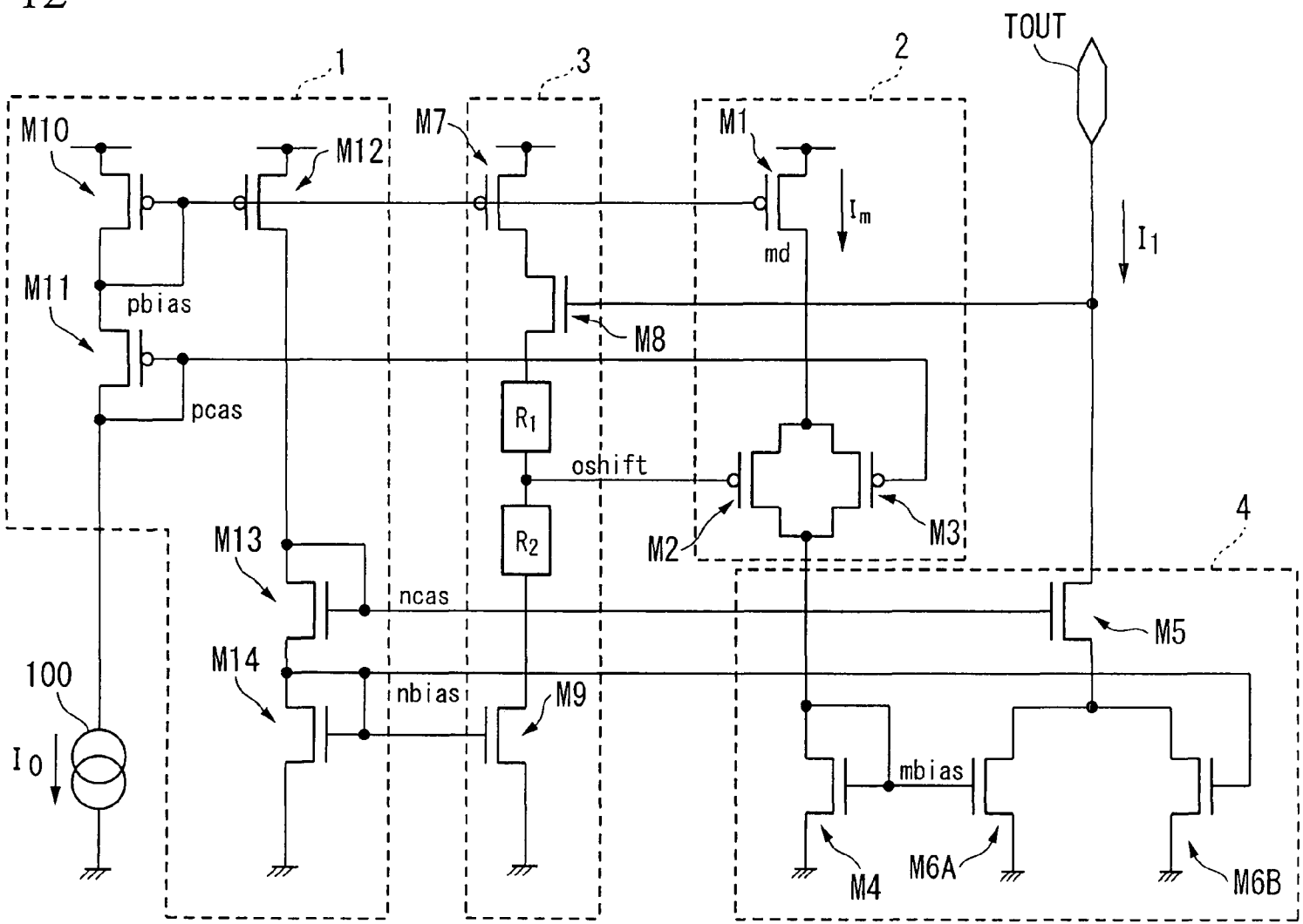
FIG. 12 is a circuit diagram showing the constitution of a constant current source circuit according to a seventh embodiment of the present invention.

FIG. 12 is a circuit diagram showing a constant current source circuit according to a seventh embodiment of the present invention. The seventh embodiment shown in FIG. 12 is designed to additionally insert resistors R1 and R2 in series between the source of the transistor M8 and the drain of the transistor M9 in the control voltage generation section 3 used in the second embodiment shown in FIG. 5. In addition, the connection point between the resistors R1 and R2 is connected to the gate of the transistor M2, whereby the voltage at the connection point is applied to the gate of the transistor M2 as the control voltage oshift.

Compared to the second embodiment, the seventh embodiment is designed to additionally insert the resistors R1 and R2 between the transistors M8 and M9, thus reducing the control voltage oshift. This moves the dotted lines of FIGS. 7 and 8 rightward so as to make the constant current source circuit of the seventh embodiment operate in a further low-voltage region.

It is apparent that the present invention is not limited to the above embodiments, but may be modified and changed without departing from the scope and spirit of the invention.

What is claimed is:

1. A constant current source circuit comprising:

a control voltage generation section that detects an output voltage at an output terminal and generates a control voltage based on the detected output voltage;

a reference current adjustment section that adjusts a reference current based on the control voltage; and a current mirror section that outputs an output current in response to the adjusted reference current at the output terminal, wherein the reference current adjustment section includes a first transistor configured of a p-channel MOS transistor in which a source thereof is connected to a voltage supply and a gate thereof receives a first bias voltage; a second transistor configured of a p-channel MOS transistor in which a source thereof is connected to a drain of the first transistor and a gate thereof receives the control voltage; a third transistor configured of a p-channel MOS transistor in which a source thereof is connected to the source of the second transistor, a gate thereof receives a second bias voltage, and a drain thereof is connected to a drain of the second transistor, and wherein the current mirror section includes a fourth transistor configured of an n-channel MOS transistor in which a drain thereof is connected to the drain of the third transistor, a gate thereof is connected to the drain thereof, and a source thereof is grounded; a fifth transistor configured of an n-channel MOS transistor in which a drain thereof is connected to the output terminal, and a gate thereof receives a third bias voltage; and a sixth-A transistor configured of an n-channel MOS transistor in which a drain thereof is connected to the source of the fifth transistor, and a gate thereof is connected to the gate of the fourth transistor.

2. A constant current source circuit according to claim 1, wherein the current mirror section further includes a sixth-B transistor configured of an n-channel MOS transistor in which a drain thereof is connected to the drain of the sixth-A transistor, a gate thereof receives a fourth bias voltage, and a source thereof is grounded.

3. A constant current source circuit according to claim 1, wherein the control voltage generation section outputs the control voltage which is shifted in level by an adjustment voltage.

4. A constant current source circuit according to claim 3, wherein the control voltage generation section includes a seventh transistor configured of a p-channel MOS transistor in which a source thereof is connected to the voltage supply, and a gate thereof receives the first bias voltage; an eighth transistor configured of an n-channel MOS transistor in which a drain thereof is connected a drain of the seventh transistor, and a gate thereof is connected to the output terminal; and a ninth transistor configured of an n-channel MOS transistor in which a drain thereof is connected to a source of the eighth transistor, a gate thereof receives an internal bias voltage produced in the current mirror section, and a source thereof is grounded such that the control voltage is output from a source of the eighth transistor.

5. A constant current source circuit according to claim 4, wherein the control voltage generation section further includes a plurality of resistors which are connected in series between the source of the eighth transistor and the drain of the ninth transistor, such that the control voltage is output from a connection point between the plurality of resistors.

6. A constant current source circuit according to claim 3 further including a bias generation section that generates the first bias voltage allowing the reference current to flow through the first transistor, the second bias voltage applied to the gate of the third transistor serving as a cascode transistor, and the third bias voltage applied to the gate of the fifth transistor serving as a cascode transistor.

7. A constant current source circuit according to claim 6, wherein the bias generation section includes a tenth transistor configured of a p-channel MOS transistor in which a source thereof is connected to the voltage supply, and a gate and a drain thereof are connected together; an eleventh transistor configured of a p-channel MOS transistor in which a source thereof is connected to the drain of the tenth transistor, and a gate and a drain thereof are connected together; a constant current source which is connected to the drain of the eleventh transistor and is also grounded so as to generate the reference current; a twelfth transistor configured of a p-channel MOS transistor in which a source thereof is connected to the voltage supply and a gate thereof is connected to the drain of the tenth transistor; a thirteenth transistor configured of an n-channel MOS transistor in which a drain thereof is connected to the drain of the twelfth transistor, and a gate thereof is connected to the drain thereof; and a fourteenth transistor configured of an n-channel MOS transistor in which a drain thereof is connected to a source of the thirteenth transistor, a gate thereof is connected to the drain thereof, and a source thereof is grounded, and wherein the first bias voltage is output from the drain of the tenth transistor, the second bias voltage is output from the drain of the eleventh transistor, and the third bias voltage is output from the drain of the thirteenth transistor.

8. A constant current source circuit according to claim 7, wherein a fourth bias voltage is output from the drain of the fourteenth transistor included in the bias generation section.

9. A constant current source circuit according to claim 3, wherein the control voltage generation section includes a seventh transistor configured of a p-channel MOS transistor in which a source thereof is connected to the voltage supply, and a gate thereof receives the first bias voltage; an eighth transistor configured of a p-channel MOS transistor in which a source thereof is connected to a drain of the seventh transistor, and a gate thereof is connected to the output terminal; a twenty-fifth transistor configured of an n-channel MOS transistor in which a drain thereof is connected a drain of the eighth transistor and a gate thereof receives the third bias voltage; and a twenty-sixth transistor configured of an n-channel MOS transistor in which a drain thereof is connected to a source of the twenty-fifth transistor, a gate thereof receives a fourth bias voltage, and a source thereof is grounded, and wherein the control voltage is output from the drain of the seventh transistor.

10. A constant current source circuit according to claim 9 further comprising a bias generation section which generates the first bias voltage allowing the reference current to flow through the first transistor, the second bias voltage applied to the gate of the third transistor serving as a cascode transistor, the third bias voltage applied to the gate of the fifth transistor serving as a cascode transistor, and a fourth bias voltage applied to a gate of a sixth-B transistor configured of an n-channel MOS transistor coupled to the sixth-A transistor.

11. A constant current source circuit according to claim 10, wherein the bias generation section includes a tenth transistor configured of a p-channel MOS transistor whose source is connected to the voltage supply; an eleventh transistor configured of a p-channel MOS transistor in which a source thereof is connected to drain of the tenth transistor and a drain thereof is connected to a gate of the tenth transistor; a constant current source which is connected to the drain of the eleventh transistor and is also grounded so as to generate the reference current; a twelfth transistor configured of a p-channel MOS transistor in which a source thereof is connected to the voltage supply and a gate thereof is connected to the drain of the eleventh transistor; a fifteenth transistor configured of a p-channel MOS transistor in which a source thereof is connected to the drain of the twelfth transistor and a gate thereof is connected to the gate of the eleventh transistor; a sixteenth transistor configured of an n-channel MOS transistor whose drain is connected to the drain of the fifteenth transistor; a seventeenth transistor configured of an n-channel MOS transistor in which a drain thereof is connected to a source of the sixteenth transistor, a gate thereof is connected to the drain of the sixteenth transistor, and a source thereof is grounded; an eighteenth transistor configured of a p-channel MOS transistor in which a source thereof is connected to the voltage supply, a gate thereof is connected to the gate of the fifteenth transistor, and a drain thereof is connected to the gate thereof; a nineteenth transistor configured of an n-channel MOS transistor in which a drain thereof is connected to the drain of the eighteenth transistor and a gate thereof is connected to a gate of the sixteenth transistor; a twentieth transistor configured of an n-channel MOS transistor in which a drain thereof is connected to a source of the nineteenth transistor, a gate thereof is connected to the drain of the sixteenth transistor, and a source there is grounded; a twenty-first transistor configured of a p-channel MOS transistor in which a source thereof is connected to the voltage supply and a gate thereof is connected to the gate of the twelfth transistor; a twenty-second transistor configured of a p-channel MOS transistor in which a source thereof is connected to a drain of the twenty-first transistor and a gate thereof is connected to the gate of the eighteenth transistor; and a twenty-third transistor configured of an n-channel MOS transistor in which a drain and a gate thereof are connected to a drain of the twenty-second transistor, the gate thereof is also connected to the gate of the nineteenth transistor, and a source thereof is grounded, and wherein the first bias voltage is output from the drain of the eleventh transistor, the second bias voltage is output from the drain of the eighteenth transistor, the third bias voltage is output from the drain of the twenty-third transistor, and the fourth bias voltage is output from the sixteenth transistor.

12. A constant current source circuit comprising:

a reference current adjustment section including a transistor having a gate coupled to a control voltage, and adjusting a reference current based on an output voltage at an output terminal; and a current mirror section including a transistor having a drain coupled to a drain of the transistor of the reference current adjustment section, and outputting an output current in response to the adjusted reference current, wherein the reference current adjustment section further includes a first transistor configured of a p-channel MOS transistor in which a source thereof is connected to a voltage supply and a gate thereof receives a first bias voltage; and the transistor of the reference current adjustment section comprises a second transistor configured of a p-channel MOS transistor in which a source thereof is connected to a drain of the first transistor and a gate thereof receives the output voltage at the output terminal; and a third transistor configured of a p-channel MOS transistor in which a source thereof is connected to the source of the second transistor, a gate thereof receives a second bias voltage, and a drain thereof is connected to a drain of the second transistor, and wherein the current mirror section includes a fourth transistor configured of an n-channel MOS transistor in which a drain thereof is connected to the drain of the third transistor, a gate thereof is connected to the drain thereof, and a source thereof is grounded; a fifth transistor configured of an n-channel MOS transistor in which a drain thereof is connected to the output terminal and a gate thereof receives a third bias voltage; a sixth-A transistor configured of an n-channel MOS transistor in which a drain thereof is connected to the source of the fifth transistor and a gate thereof is connected to the gate of the fourth transistor; and a sixth-B transistor configured of an n-channel MOS transistor in which a drain thereof is connected to a drain of the sixth-A transistor, a gate thereof receives a fourth bias voltage, and a source thereof is grounded.

13. A constant current source circuit according to claim 12, further including a bias generation section that generates the first bias voltage allowing the reference current to flow through the first transistor, the second bias voltage applied to the gate of the third transistor serving as a cascode transistor, the third bias voltage applied to the gate of the fifth transistor serving as a cascode transistor, and the fourth bias voltage applied to the gate of the sixth-B transistor.

14. A constant current source circuit according to claim 13, wherein the bias generation section includes a tenth transistor configured of a p-channel MOS transistor whose source is connected to the voltage supply; an eleventh transistor configured of a p-channel MOS transistor in which a source thereof is connected to a drain of the tenth transistor and a drain thereof is connected to a gate of the tenth transistor; a constant current source which is connected to the drain of the eleventh transistor and is also grounded so as to generate the reference current; a twelfth transistor configured of a p-channel MOS transistor in which a source thereof is connected to the voltage supply and a gate thereof is connected to the drain of the eleventh transistor; a fifteenth transistor configured of a p-channel MOS transistor in which a source thereof is connected to a drain of the twelfth transistor and a gate thereof is connected to a gate of the eleventh transistor; a sixteenth transistor configured of an n-channel MOS transistor whose drain is connected to a drain of the fifteenth transistor; a seventeenth transistor configured of an n-channel MOS transistor in which a drain thereof is connected to a source of the sixteenth transistor, a gate thereof is connected to the drain of the sixteenth transistor, and a source thereof is grounded; an eighteenth transistor configured of a p-channel MOS transistor in which a source thereof is connected to the voltage supply, a gate thereof is connected to a gate of the fifteenth transistor, and a drain thereof is connected to the gate thereof; a nineteenth transistor configured of an n-channel MOS transistor in which a drain thereof is connected to the drain of the eighteenth transistor and a gate thereof is connected to the gate of the sixteenth transistor; a twentieth transistor configured of an n- channel MOS transistor in which a drain thereof is connected to a source of the nineteenth transistor, a gate thereof is connected to the drain of the sixteenth transistor, and a source thereof is grounded; a twenty-first transistor configured of a p-channel MOS transistor in which a source thereof is connected to the voltage supply and a gate thereof is connected to the gate of the twelfth transistor; a twenty-second transistor configured of a p-channel MOS transistor in which a source thereof is connected to a drain of the twenty-first transistor, and a gate thereof is connected to the gate of the eighteenth transistor; and a twenty-third transistor configured of an n-channel MOS transistor in which a drain thereof is connected to a gate thereof and a drain of the twenty-second transistor, a gate thereof is connected to the gate of the nineteenth transistor, and a source thereof is grounded, and wherein the first bias voltage is output from the drain of the eleventh transistor, the second bias voltage is output from the drain of the eighteenth transistor, the third bias voltage is output from the drain of the twenty-third transistor, and the fourth bias voltage is output from the drain of the sixteenth transistor.

15. A circuit comprising:

a first transistor and second transistor coupled between an output terminal and a first power supply line in series, the second transistor including a control electrode coupled to a first node;

a bias generating circuit that includes a bias voltage output terminal coupled to a control electrode of the first transistor to supply the control electrode with a bias voltage;

a third transistor comprising:

source and drain electrodes, one of the source and drain electrodes being coupled to the first node and the other of the source and drain electrodes being coupled to the first power supply line; and a control electrode coupled to the first node; and a control circuit coupled to the output terminal and the first node, that generates a control current, and that supplies the first node with the control current.

16. The circuit according to claim 15, wherein the control circuit includes a control voltage generating circuit coupled to the output terminal and a reference current adjustment circuit coupled to the first node.

17. The circuit according to claim 16, wherein the control voltage generating circuit includes a fourth transistor coupled between a second node and a third node and including a control electrode coupled to the output terminal.

18. The circuit according to claim 17, wherein the reference current adjustment circuit includes a fifth transistor coupled between a fourth node and the first node and having a control electrode coupled to the third node.

19. The circuit according to claim 18, wherein the control voltage generating circuit includes a sixth transistor coupled between the second node and a second power supply line and a seventh transistor coupled between the third node and the first power supply line and having a control electrode coupled to the first node, and the reference current adjustment circuit includes an eighth transistor coupled between the fourth node and the second power supply line having a control electrode coupled to a control electrode of the sixth transistor.

20. The circuit according to claim 18, wherein the reference current adjustment circuit includes a sixth transistor coupled between the fourth node and the first node and having a control electrode receiving another bias voltage from the bias generating circuit.

21. The circuit according to claim 20, wherein the control voltage generating circuit includes a seventh transistor coupled between the second node and a second power supply line and an eighth transistor coupled between the third node and the first power supply line and having a control electrode coupled to the first node, and the reference current adjustment circuit includes a ninth transistor coupled between the fourth node and the second power supply line having a control electrode coupled to a control electrode of the seventh transistor.

* * * * *